US012679689B2

(12) United States Patent
Mita et al.

(10) Patent No.: US 12,679,689 B2
(45) Date of Patent: Jul. 14, 2026

(54) SHEET HANDLING APPARATUS THAT HANDLES MULTIPLE SHEETS AND IMAGE FORMING SYSTEM

(71) Applicant: CANON KABUSHIKI KAISHA, Tokyo (JP)

(72) Inventors: Takuro Mita, Kanagawa (JP); Koji Kawamura, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 279 days.

(21) Appl. No.: 18/659,285

(22) Filed: May 9, 2024

(65) Prior Publication Data

US 2024/0383716 A1 Nov. 21, 2024

(30) Foreign Application Priority Data

May 15, 2023 (JP) ..... 2023-080366

(51) Int. Cl.
*B65H 37/04* (2006.01)
*B65H 31/30* (2006.01)
*B65H 39/10* (2006.01)

(52) U.S. Cl.
CPC ..... *B65H 39/10* (2013.01); *B65H 31/3072* (2013.01); *B65H 37/04* (2013.01); *B65H 2801/27* (2013.01); *B65H 2801/48* (2013.01)

(58) Field of Classification Search
CPC .. G03G 2215/00822; B42C 1/12; B42C 9/00; B42C 19/02; B42C 19/18; B65H 37/04; B65H 2301/4382; B65H 2301/43822; B65H 2301/51614; B65H 2801/27; B65H 2801/48
USPC ..... 270/58.07, 58.08
See application file for complete search history.

(56) References Cited

U.S. PATENT DOCUMENTS

| | | | | |
|---|---|---|---|---|
| 9,604,479 | B2 * | 3/2017 | Kokura | B41J 13/0036 |
| 9,676,584 | B2 * | 6/2017 | Takemasa | B65H 31/34 |
| 10,584,011 | B2 * | 3/2020 | Matsuki | B65H 29/145 |
| 2021/0178623 | A1 | 6/2021 | Kubota | |
| 2022/0162029 | A1 | 5/2022 | Sugai et al. | |

FOREIGN PATENT DOCUMENTS

| | | | |
|---|---|---|---|
| JP | 2014151579 | A | 8/2014 |
| JP | 2021095291 | A | 6/2021 |
| KR | 1020050077268 | A | 8/2005 |
| KR | 1020070089616 | A | 8/2007 |
| KR | 1020110005640 | A | 1/2011 |
| KR | 1020120094420 | A | 8/2012 |

(Continued)

OTHER PUBLICATIONS

Extended European Search Report issued in European Appln. No. 24175621.2 mailed Aug. 1, 2024.

*Primary Examiner* — Leslie A Nicholson, III
(74) *Attorney, Agent, or Firm* — ROSSI, KIMMS & McDOWELL LLP

(57) ABSTRACT

A bundling mechanism creates a sheet bundle including N sheets including an M-th sheet to be included in a k-th booklet and a first sheet to be included in a k+1-th booklet. The k is an integer from 1 to L−1. The M is not a multiple of N. A adhesion mechanism bonds together a preceding sheet and a subsequent sheet stacked at a stacker, except for the M-th sheet to be included in the k-th booklet and the first sheet to be included in the k+1-th booklet.

17 Claims, 15 Drawing Sheets

(56) References Cited

FOREIGN PATENT DOCUMENTS

| | | | |
|---|---|---|---|
| KR | 1020170016788 | A | 2/2017 |
| KR | 1020180073635 | A | 7/2018 |
| KR | 1020230153294 | A | 11/2023 |

* cited by examiner

SHEET HANDLING APPARATUS THAT HANDLES MULTIPLE SHEETS AND IMAGE FORMING SYSTEM

BACKGROUND OF THE INVENTION

Field of the Invention

The present disclosure relates to a sheet handling apparatus that handles multiple sheets and an image forming system.

Description of the Related Art

Japanese Patent Laid-Open No. 2021-095291 discloses a post-processing apparatus that binds a sheet bundle conveyed to a processing tray using a stapler and discharges the sheet bundle to a discharge tray. With such a post-processing apparatus, until the binding process of a preceding sheet bundle is complete, the subsequent sheet bundle is made to wait at a buffering portion. This enables image formation to continue without a drop in productivity.

Staples are pushed through a plurality of sheets to form a single booklet. Thus, only a plurality of sheets to be formed into a single booklet should be stacked on the processing tray. If a sheet corresponding to a portion of the subsequent booklet is conveyed to the processing tray before the binding process of the preceding booklet is completed, the sheet for the subsequent booklet will be bound as a portion of the preceding booklet. Accordingly, the subsequent sheets must wait until the preceding booklet is discharged from the processing tray, leading to a decrease in the productivity of the sheet handling apparatus.

SUMMARY OF THE INVENTION

The disclosure provides a sheet handling apparatus comprising: a bundling mechanism that forms a sheet bundle including a maximum of N sheets, with sheets being received one at a time; a conveyer that conveys the sheet bundle in a case where formation of the sheet bundle is complete; a stacker that stacks the sheet bundle conveyed by the conveyer; an adhesion mechanism that creates a booklet including M sheets by performing a bonding process each time the sheet bundle is stacked at the stacker; and a discharger that, in a case where formation of L booklets is complete at the stacker, discharges the L booklets from the stacker, wherein the bundling mechanism is configured to create a sheet bundle including N sheets including an M-th sheet to be included in a k-th booklet and a first sheet to be included in a k+1-th booklet, where k is an integer from 1 to L−1 and M is not a multiple of N, and the adhesion mechanism is configured to bond together a preceding sheet and a subsequent sheet stacked at the stacker, except for the M-th sheet to be included in the k-th booklet and the first sheet to be included in the k+1-th booklet.

Further features of the present disclosure will become apparent from the following description of exemplary embodiments (with reference to the attached drawings).

DESCRIPTION OF THE EMBODIMENTS

Figure 1:
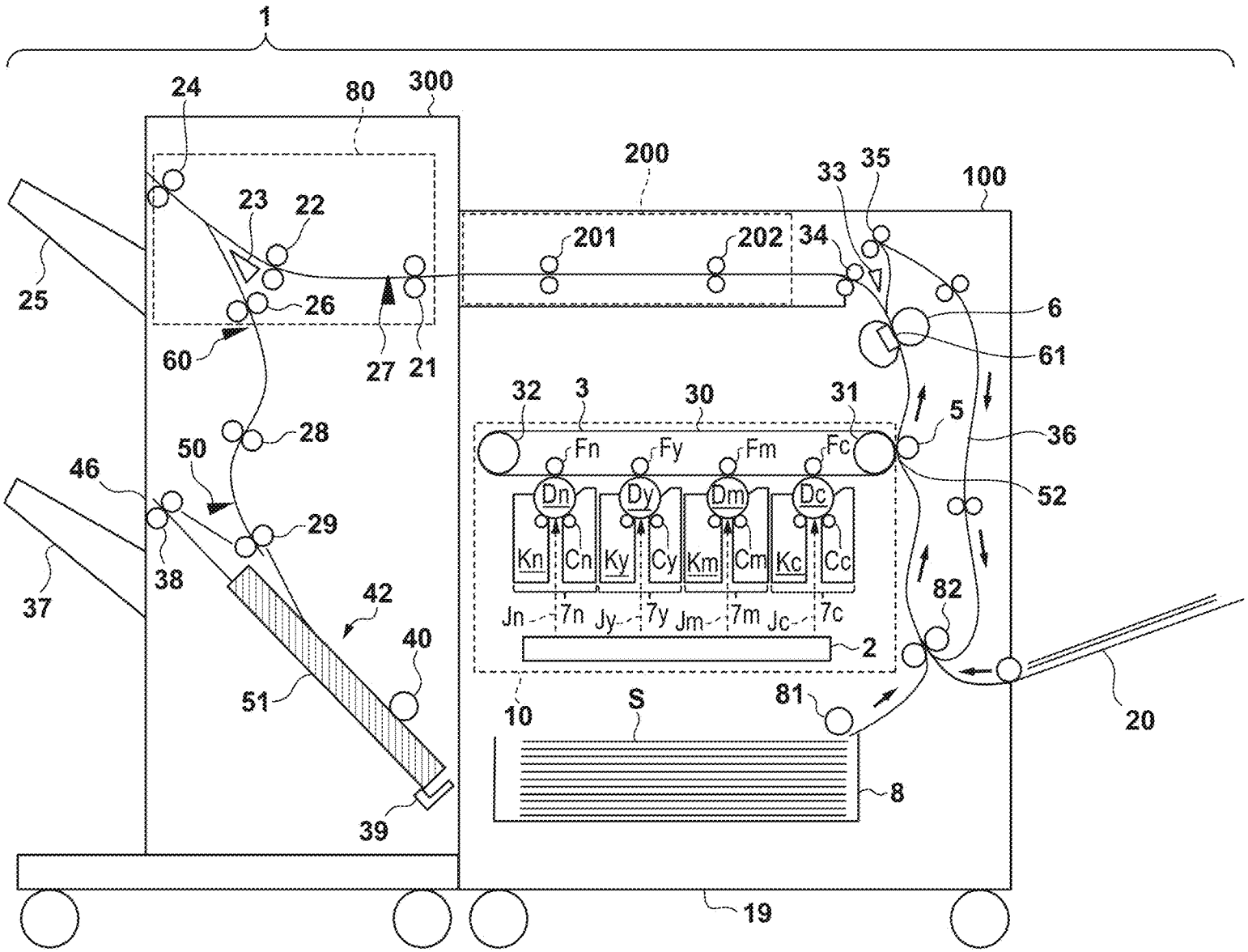
FIG. 1 is a diagram for describing an image forming system.

Hereinafter, embodiments will be described in detail with reference to the attached drawings. Note, the following embodiments are not intended to limit the scope of the claimed invention. Multiple features are described in the embodiments, but limitation is not made to an invention that requires all such features, and multiple such features may be combined as appropriate. Furthermore, in the attached drawings, the same reference numerals are given to the same or similar configurations, and redundant description thereof is omitted.

First Embodiment (1) Image Forming System

As illustrated in FIG. 1, an image forming system 1 includes an image forming apparatus 100 and a post-processing apparatus 300. The post-processing apparatus 300 is a sheet handling apparatus connected to the image forming apparatus 100. The image forming apparatus 100 forms an image on a sheet S, a printing material. An intermediate conveyance unit 200 conveys the sheet S with a formed image to the post-processing apparatus 300. The post-processing apparatus 300 performs post-processing on the sheet S as necessary and outputs the sheet S.

The image forming apparatus 100 includes a sheet cassette 8, an image forming unit 10, a fixing device 6, and a casing 19 that houses these. The image forming unit 10 forms a toner image on the sheet S fed from the sheet cassette 8. The fixing device 6 performs a fixing process to fix the toner image on the sheet S.

The sheet cassette 8 is provided on the lower portion of the image forming apparatus 100. The sheet cassette 8 is inserted into the casing 19 in a removable manner and can house a plurality of the sheets S. A conveyance roller 81 feeds the sheets S from the sheet cassette 8 and passes the sheets S to a conveyance roller pair 82. The sheets S can also be fed one at a time from a multi-tray 20.

The image forming unit 10 is a tandem electrophotographic unit includes four process cartridges 7*n*, 7*y*, 7*m*, 7*c*, a scanner unit 2, and a transfer unit 3. Note that an "n" assigned to a reference sign means an adhesive. "y", "m", and "c" correspond to yellow, magenta, and cyan, respectively. The process cartridges 7*n*, 7*y*, 7*m*, 7*c* include replaceable components involved in the image forming process in an integrated manner. In other words, a plurality of components are integrally formed to form the process cartridges 7*n*, 7*y*, 7*m*, 7*c*.

The process cartridges 7*n*, 7*y*, 7*m*, 7*c* include, respectively, a corresponding toner housing portion Kn, Ky, Km, Kc, photosensitive drum Dn, Dy, Dm, Dc, and charging roller Cn, Cy, Cm, and Cc. Except for the toner type, the process cartridges 7*n*, 7*y*, 7*m*, 7*c* share essentially the same structure. The toner housing portions Ky, Km, Kc respectively house yellow, magenta, and cyan toner for forming a visual image on the sheet S. The toner housing portion Kn houses adhesive toner Tn. The adhesive toner Tn is a powder adhesive used in the thermocompression bonding of a plurality of the sheets S in the post-processing apparatus 300. Note that an adhesive toner image is formed on the photosensitive drum Dn by developing the adhesive toner Tn. The purpose of an adhesive toner image is not to transfer visual information. Thus, the adhesive toner image is different from the toner images (normal toner images) formed by the printing toners when printing an image such as a graphic or text on the sheet S. However, hereinafter, the adhesive toner Tn is applied to the sheet S in a predetermined application pattern. Thus, the image of the adhesive toner Tn formed in a layer via development in the electrophotographic process is also treated as a toner image.

In the case of printing a black image of text or the like, the yellow, magenta, and cyan toners are layered to achieve a black image (process black). However, the image forming unit 10 may include a fifth process cartridge that uses black toner. Note that depending on the application of the image forming apparatus 100, the type and number of the printing toners can be changed.

The charging rollers Cn, Cy, Cm, and Cc are charging devices that uniformly charge the surface of their corresponding photosensitive drum Dn, Dy, Dm, Dc. The scanner unit 2 is disposed below the process cartridges 7*n*, 7*y*, 7*m*, 7*c* and above the sheet cassette 8. The scanner unit 2 emits laser beams Jn, Jy, Jm, and Jc at the corresponding photosensitive drums Dn, Dy, Dm, and Dc to form electrostatic latent images. The scanner unit 2 may be referred to as an exposure device or an optical scanning apparatus.

The toner housing portions Kn, Ky, Km, Kc adhere toner to the electrostatic latent images on the photosensitive drums Dn, Dy, Dm, and Dc to form toner images. The toner housing portions Kn, Ky, Km, Kc may be referred to as developing devices.

The transfer unit 3 includes a transfer belt 30 that functions as an intermediate transfer body (secondary image carrier). The transfer belt 30 is an endless belt installed on an inner roller 31 and a tensioning roller 32. The outer circumferential surface (image forming surface) of the transfer belt 30 faces the photosensitive drums Dn, Dy, Dm, and Dc. Primary transfer rollers Fn, Fy, Fm, and Fc are disposes so that the inner circumferential side of the transfer belt 30 faces the photosensitive drums Dn, Dy, Dm, and Dc.

The primary transfer rollers Fn, Fy, Fm, and Fc transfer the toner images from the corresponding photosensitive drum Dn, Dy, Dm, and Dc to the transfer belt 30. The primary transfer rollers Fn, Fy, Fm, and Fc may be referred to as primary transfer devices. When the transfer belt 30 rotates anticlockwise, the toner images are conveyed to the secondary transfer unit.

A secondary transfer roller 5 is disposed facing the inner roller 31, forming a transfer nip 52 between the secondary transfer roller 5 and the transfer belt 30. The transfer nip 52 transfers the toner images from the transfer belt 30 to the sheet S. The transfer nip 52 may be referred to as a secondary transfer unit.

The fixing device 6 is disposed above (on the downstream side in the conveyance direction of the sheet S) the secondary transfer roller 5. The fixing device 6 applies heat and pressure to the sheet S passing through a fixing nip 61. This fixes the toner image on the sheet S. In other words, the printing toner Ty, Tm, Tc and the adhesive toner Tn melt and bond to the sheet S.

Figure 2A:
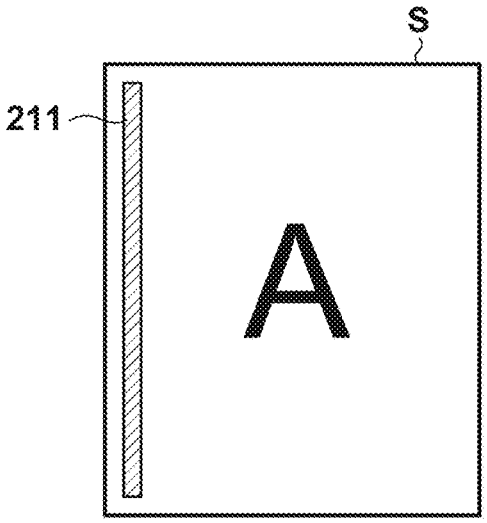
FIGS. 2A and 2B are diagrams for describing a print region of an adhesive.

FIG. 2A illustrates a print region 211 of the adhesive toner Tn. The print region 211 extends parallel with the long side of the sheet S. The print region 211 is provided at an end portion near a long side. Accordingly, by layering the plurality of sheets S and applying heat and pressure to the print region 211 of the plurality of sheets S, the post-processing apparatus 300 bonds the plurality of sheets S together and forms a booklet. The booklet in this case is a long edge bound booklet. Here, the width (length in the short side direction) of the adhesive toner image (the print region 211) is 4.0 mm, for example.

Figure 2B:
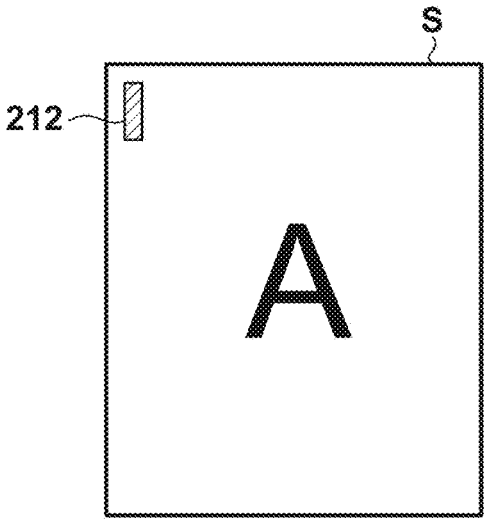

As illustrated in FIG. 2B, near the corners of the sheet S, a small print region 212 for the adhesive toner Tn may be formed. In this case, a corner bound booklet is made. The image from the adhesive toner Tn is not formed on the sheet S corresponding to the cover of the booklet.

As illustrated in FIG. 1, a switch guide 33, which is a flap-like guide member, is provided on the downstream side of the fixing device 6 in the conveyance direction of the sheet S. When one-sided printing mode for forming an image on one side of the sheet S is selected, the switch guide 33 guides the sheet S to discharge rollers 34. When double-sided printing mode for forming an image on both sides of the sheet S is selected, the switch guide 33 guides the sheet S after an image has been formed on the first surface to a switch back roller pair 35. The switch back roller pair 35 conveys the sheet S in a first direction. When the back end of the sheet S is put in a state where it can enter a double-sided conveying path 36, the switch back roller pair 35 starts rotating in reverse. This conveys the sheet S to the double-sided conveying path 36. The double-sided conveying path 36 conveys the sheet S once again to the secondary transfer unit. In this manner, an image is formed on the second surface of the sheet S.

The discharge rollers 34 convey the sheet S to the intermediate conveyance unit 200. The intermediate conveyance unit 200 includes a conveyance roller pair 201, 202. The conveyance roller pair 201, 202 convey the sheet S to the post-processing apparatus 300.

(2) Post-Processing Apparatus

The post-processing apparatus 300 is a floor-standing sheet handling apparatus. The post-processing apparatus 300 has a function for buffering a plurality of sheets, a function for aligning a plurality of sheets, and a function for bonding together a sheet bundle.

Hereinafter, the end portion of the sheet S on the front side in the conveyance direction will be referred to as the front end. The end portion of the sheet S on the back side in the conveyance direction will be referred to as the back end. Of the two end portions of the sheet S, the end which enters the post-processing apparatus 300 before the other is referred to as the first end. Of the two end portions of the sheet S, the end which enters the post-processing apparatus 300 after the other is referred to as the second end. Note that when the post-processing apparatus 300 performs switch back conveying, the front end may change from the first end to the second end, and the back end may change from the second end to the first end.

The sheet S conveyed from the intermediate conveyance unit 200 is passed to an inlet roller 21 of the post-processing apparatus 300. A sheet sensor referred to as sheet sensor 27 is disposed downstream from the inlet roller 21. When the sheet sensor 27 detects the back end of the sheet S, a conveyance roller pair 22 accelerate the sheet S. When the back end of the sheet S with an upper tray 25 set as the discharge destination arrives between the conveyance roller pair 22 and a conveyance roller pair 24, the conveyance roller pair 22 decelerates. Accordingly, the conveyance speed of the sheet S is made to match a predetermined discharge speed. The conveyance roller pair 22 discharges the sheet S to the upper tray 25.

When the sheet back end with a lower tray 37 set as the discharge destination passes a backflow prevention valve 23, the conveyance roller pair 22 stops conveying the sheet S. Thereafter, the conveyance roller pair 22 starts rotating in reverse. Accordingly, the sheet S is switched back and conveyed to a conveyance roller pair 26. When the front end of the sheet S is detected by a sheet sensor 60 provided downstream from the conveyance roller pair 26, the two rollers forming the conveyance roller pair 24 separate from one another. This allows the subsequent sheet S to be received by the conveyance roller pair 24. Also, with the preceding sheet S held between the conveyance roller pair 26, the conveyance roller pair 26 stop. Coinciding with the arrival of the subsequent sheet S, the conveyance roller pair 26 starts rotating in reverse. Accordingly, the subsequent sheet S is layered on top of the preceding sheet S. By the conveyance roller pair 26 repeatedly performing switch back on the sheets S, the plurality of sheets S are layered, forming a sheet bundle. Such an operation for forming a sheet bundle may be referred to as a buffering operation. The unit that implements the buffering operation may be referred to as a buffering portion 80.

When the sheet bundle is completed at the buffering portion 80, the conveyance roller pair 26 convey the sheet bundle to an intermediate stacker 42. The sheet bundle passes a conveyance roller pair 28 and a sheet sensor 50. Also, the sheet bundle is conveyed to the intermediate stacker 42 by a kick-out roller 29. A movable vertical alignment plate 39 is disposed at the most downstream portion of the intermediate stacker 42 in a standby position. By abutting the sheet bundle against the vertical alignment plate 39, the sheet bundle is aligned.

A plurality of sheet bundles are stacked in order at the intermediate stacker 42. Accordingly, a predetermined number of the sheets S for forming a booklet are stacked at the intermediate stacker 42. When the alignment of the predetermined number of sheets S ends, a thermocompression bonding unit 51 performs a binding operation (bonding process) to form a booklet. When the vertical alignment plate 39 moves from the standby position to the discharge position, the booklet is pushed toward discharge rollers 38. When the front end of the booklet is held between the discharge rollers 38, the vertical alignment plate 39 stops and then returns to the standby position. The discharge rollers 38 discharge the booklet received from the vertical alignment plate 39 from a discharge opening 46 to the lower tray 37.

As described above, using the buffering portion 80, the post-processing apparatus 300 forms a sheet bundle made from the plurality of sheets S and conveys the sheet bundle to the intermediate stacker 42. However, one sheet S may be conveyed to the intermediate stacker 42.

(3) Buffering Operation (Layering Operation)

The buffering operation is an operation including making a subsequent sheet or a sheet bundle wait at the buffering portion 80 until the post-processing on the preceding sheet bundle has been completed at the intermediate stacker 42. According to the buffering operation, the image forming system 1 can continuously perform image forming jobs including post-processing without a decrease in the productivity (number of output images per unit time) of the image forming apparatus 100.

The buffering operation will now be described using FIGS. 3A to 3H. Herein, the first sheet S conveyed is denoted as S1. The second sheet S conveyed is denoted as S2. The sheet bundle formed by layering the sheet S1 and the sheet S2 is denoted as W. The conveyance speed of the conveyance roller pairs 22, 24, and 26 are denoted as V1 and V2 (V1<V2). The conveyance speed V1 is the conveyance speed before acceleration, and the conveyance speed V2 is the conveyance speed after acceleration. Herein, acceleration (increase in speed) is an acceleration process for ensuring the necessary sheet interval (hereinafter, referred to as sheet interval) when the sheets S are layered at the buffering portion 80 and when the sheet bundle is sent downstream. The sheet interval typically refers to the distance or conveyance time from the back end of the preceding sheet Si until the front end of the preceding sheet Si+1 (i being any integer).

Figure 3A:
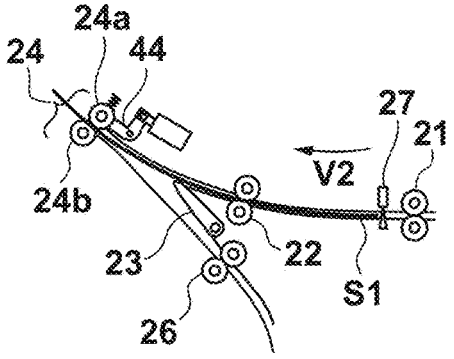
FIGS. 3A to 3H are diagrams for describing a buffering operation.
Figure 3B:
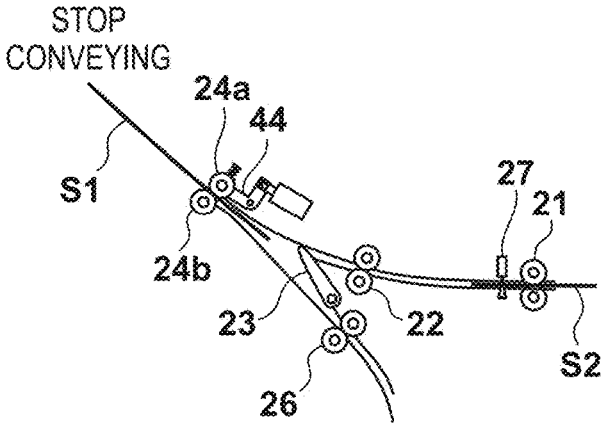
Figure 3C:
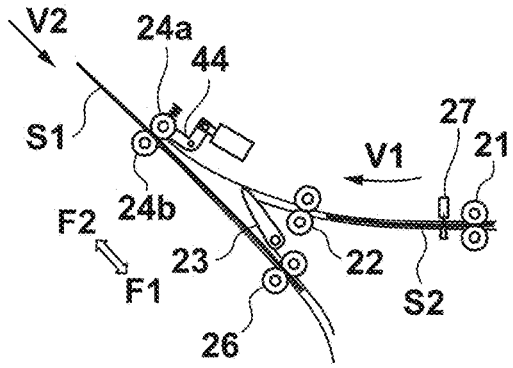

FIG. 3A illustrates the conveyance speed of the conveyance roller pair 22 and the conveyance roller pair 24 increases to V2 at the timing when the back end (second end) of the sheet S1 passes the sheet sensor 27. FIG. 3B illustrates the sheet S1 temporarily stopping at the timing when the back end of the sheet S1 moves a predetermined distance from the sheet sensor 27 and passes the backflow prevention valve 23. The conveyance speed of the conveyance roller pair 22 returns to V1 in order to receive the sheet S2. FIG. 3C illustrates the sheet S1 being conveyed at the conveyance speed V2 in an F1 direction, with the rotation direction of the conveyance roller pair 24 having switched from forward to reverse. The sheet S2 is conveyed to the conveyance roller pair 22 at the conveyance speed V1.

Figure 3D:
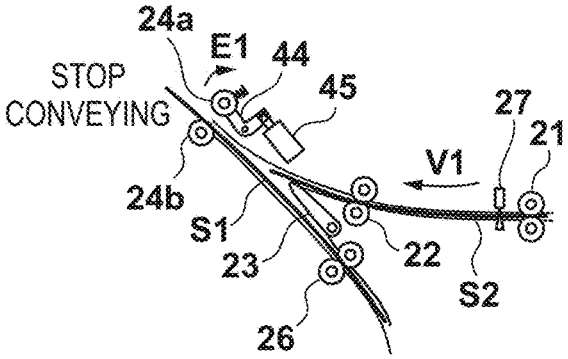

FIG. 3D illustrates the front end (second end) of the sheet S1 stopped at a conveyed position a predetermined amount away from the conveyance roller pair 26. Also, a separation lever 44 separates the upper roller 24*a* in an E1 direction at the timing when the sheet S1 is held between the conveyance roller pair 26. After the upper roller 24*a* has separated from the lower roller 24*b*, the front end (first end) of the sheet S2 passes through the conveyance roller pair 24. The separation lever 44 is rotatably connected to a plunger solenoid 45 on the solenoid connection shaft. When a current runs through the plunger solenoid 45, the separation lever 44 rotates in the E1 direction, putting the conveyance roller pair 24 in a separated state. When the current to the plunger solenoid 45 stops being supplied, a pressure spring moves the upper roller 24*a* in an E2 direction.

Figure 3E:
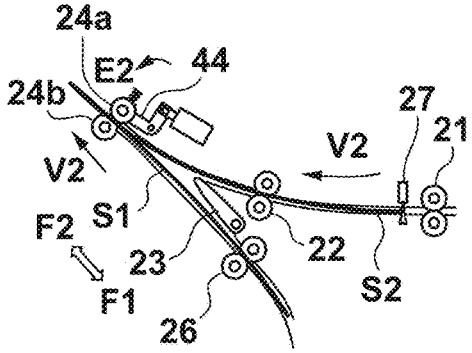

FIG. 3E illustrates the conveyance speed of the conveyance roller pair 22 and the conveyance roller pair 24 increases to V2 after the back end (second end) of the sheet S2 has passed the sheet sensor 27. The conveyance roller pair 26 starts rotating in reverse at the timing when the back end (second end) of the sheet S2 has passed the sheet sensor 27. Accordingly, the sheet S1 held between the conveyance roller pair 26 is conveyed in an F2 direction. The upper roller 24*a* moves in the E2 direction at the timing when the conveyance speed of the sheet S1 and of the sheet S2 are equal, and the upper roller 24*a* and the lower roller 24*b* cooperate to hold the sheet S1 and the sheet S2 between them. The conveyance speed (circumferential speed) of the conveyance roller pair 24 is adjusted to V2, which is the conveyance speed of the sheet S1 and the sheet S2, up until the sheet S1 and the sheet S2 are held between the conveyance roller pair 24.

Figure 3F:
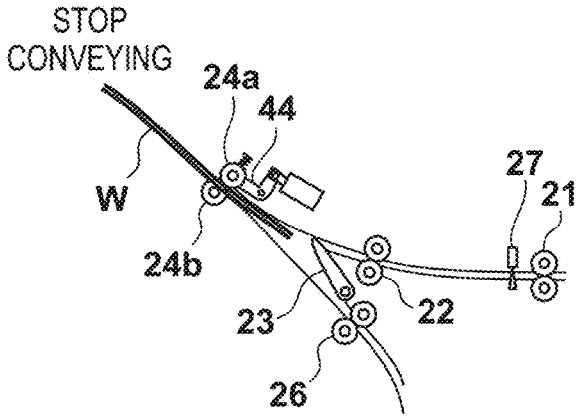

FIG. 3F illustrates the sheet bundle W being formed of the sheet S1 and the sheet S2 after the back end (second end) of the sheet S2 has passed the backflow prevention valve 23. As in FIGS. 3B and 3C, in FIG. 3F also, the sheet bundle W is temporarily stopped and the rotation direction of the conveyance roller pair 24 is switched from forward to reverse at the timing when the back end of the sheet bundle W after the back end of the sheet bundle W has passed the backflow prevention valve 23.

Figure 3G:
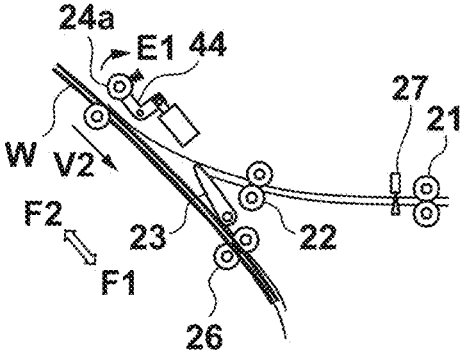

FIG. 3G illustrates the sheet bundle W being conveyed in the F1 direction at the conveyance speed V2 toward a post-processing portion 71. The separation lever 44 separates the upper roller 24*a* from the lower roller 24*b* at the timing when the sheet bundle W is held between the conveyance roller pair 26. In other words, the upper roller 24*a* moves in the E1 direction.

Figure 3H:
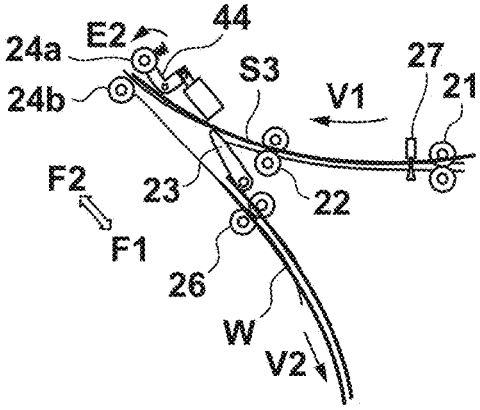

FIG. 3H illustrates a sheet S3 being newly buffered after the sheet bundle W is sent to the post-processing portion 71. In this case, the upper roller 24*a* temporarily stops after the back end of the sheet bundle W has passed the conveyance roller pair 24. With the conveyance roller pair 24 in a separated state, the sheet S3 enters the conveyance roller pair 24. Note that when the back end of the sheet S3 has passed the sheet sensor 27, the conveyance speed of the conveyance roller pair 22 is increased from V1 to V2. Thereafter, the upper roller 24*a* moves in the E2 direction, and the conveyance roller pair 24 are put in an abutting state. The rotation direction of the upper roller 24*a* switches from reverse to forward, and the sheet S3 is conveyed in the F2 direction at the conveyance speed V2. Note that the conveyance roller pair 24 starts conveying the sheet S3 before the back end of the sheet S3 has passed the conveyance roller pair 22.

Here, the two sheets S1 and S2 are buffered, but this is merely an example. In a case where the third sheet S3 is buffered, after the operation in FIG. 3G, the front end of the sheet bundle W stops at a conveyed position (temporary stop position) a predetermined amount away from the conveyance roller pair 26. Thereafter, the layering operation is applied to the sheet bundle W and the sheet S3. The layering operation is the same as the layering operation of the sheet S1 and sheet S2 described in relation to FIGS. 3D to 3G.

A sheet number control unit 412, for a print job in which a plurality of pages are continuously printed, manages a number N of the sheets S to be buffered at the buffering portion 80 on the basis of a maximum number M of the sheets S that can be buffered at the buffering portion 80 and conveyance information of the sheets S. The sheet number control unit 412 determines whether to discharge the sheet bundle W formed at the buffering portion 80 downstream or layer the subsequent sheet S with the sheet bundle W. In the present example, the maximum number of sheets M is assumed to be 5 sheets.

(4) Alignment Operation

FIGS. 4A to 4D illustrate the operation for aligning the sheets S performed at the intermediate stacker 42. In the initial state, the intermediate stacker 42 is empty. As an example, the sheet bundle W including five sheets S is conveyed from the buffering portion 80 to the intermediate stacker 42.

A Y direction is the direction parallel with the stacking surface (stacking plate) for the sheets S at the intermediate stacker 42 and the direction parallel with the conveyance direction in which the sheets S are conveyed from the kick-out roller 29 to the intermediate stacker 42. The Y direction may be referred to as the vertical direction. An X direction is the direction parallel with the stacking surface of the sheets S at the intermediate stacker 42 and orthogonal to the Y direction. The X direction may be referred to as the horizontal direction. AZ direction is the direction orthogonal to the X direction and the Y direction (normal direction of the stacking surface, thickness direction of the stacked sheets S). The Z direction may be referred to as the height direction. The opposite directions of the X direction, the Y direction, and the Z direction may be referred to as the −X direction, the −Y direction, and the −Z direction, respectively.

The vertical alignment plate 39 and a vertical alignment roller 40 function as a first alignment unit that aligns the sheets S in the first direction (Y direction). The vertical alignment plate 39 is disposed at the most downstream portion of the intermediate stacker 42 in the Y direction. The vertical alignment plate 39 is a reference member (first reference member) corresponding to the reference for the sheet position in the Y direction. The vertical alignment roller 40 is a conveying member that conveys the sheets S in the Y direction to abut the sheets S with the vertical alignment plate 39 and align them. The vertical alignment plate 39 includes a plurality of abutting portions 39*a* to 39*c* disposed at intervals in the X direction. The plurality of abutting portions 39*a* to 39*c* come into contact with the end portions of the sheets S. Note that the vertical alignment plate 39 and the vertical alignment roller 40 are integrally formed as a movable unit 59 that can move in the Y direction. The movable unit 59 can move in the Y direction via a drive source such as a motor. In other words, the position of the vertical alignment plate 39 and the vertical alignment roller 40 can be adjusted in the Y direction. Horizontal alignment joggers 41*a* to 41*c* function as a second alignment unit that aligns sheets in the second direction (X direction) orthogonal to the first direction.

The horizontal alignment joggers 41*a* to 41*c* move in the X direction via a drive source such as a motor and press against the side ends of the sheets S stacked in the intermediate stacker 42. Horizontal alignment plates 72*a* and 72*b* are reference members corresponding to the reference for the position of the sheets S in the X direction. The horizontal alignment plates 72*a* and 72*b* are disposed facing the horizontal alignment joggers 41*a* and 41*b* in the X direction.

(4-1) Preparation Stage

Figure 4A:
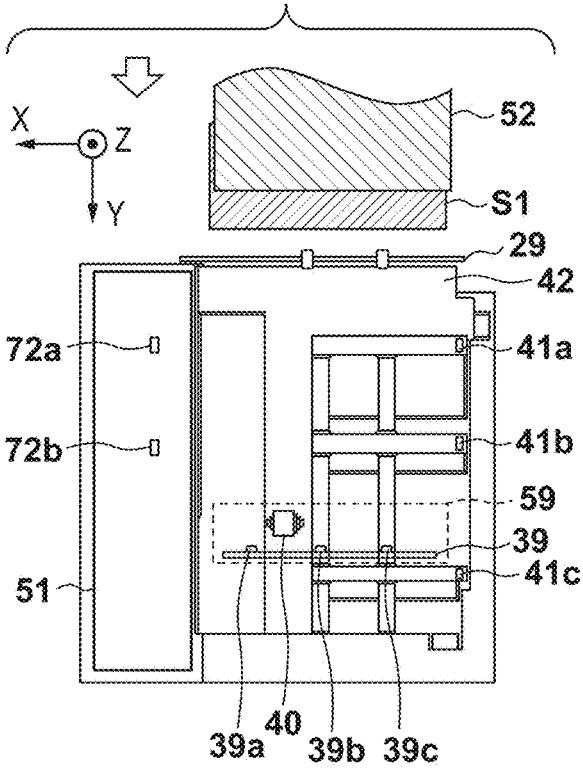
FIGS. 4A to 4D are diagrams for describing an alignment operation and a bonding operation.

As illustrated in FIG. 4A, the sheets S1 to S5 are conveyed toward the kick-out roller 29. The sheets S1 to S5 may be conveyed to the intermediate stacker 42 in a state where the sheet Si located lower down is jutting out in the Y direction past the sheet Si+1 located higher up. Before the sheets S are stacked at the intermediate stacker 42, the vertical alignment plate 39 matches the size of the sheets S to be aligned and move to a predetermined standby position. The standby position is set so that the end portion positions of the sheets S are constant in the −Y direction, irrespective of the size of the sheets S. In other words, the standby position is a position whereby the distance in the Y direction from the nip position of the kick-out roller 29 to the vertical alignment plate 39 is slightly longer than the length of the sheets in the Y direction. The horizontal alignment joggers 41*a* to 41*c* wait at a position separated outward in the X direction from the sheets S being conveyed so as to not interfere with the conveying of the sheets S.

(4-2) Vertical Alignment Stage

Figure 4B:
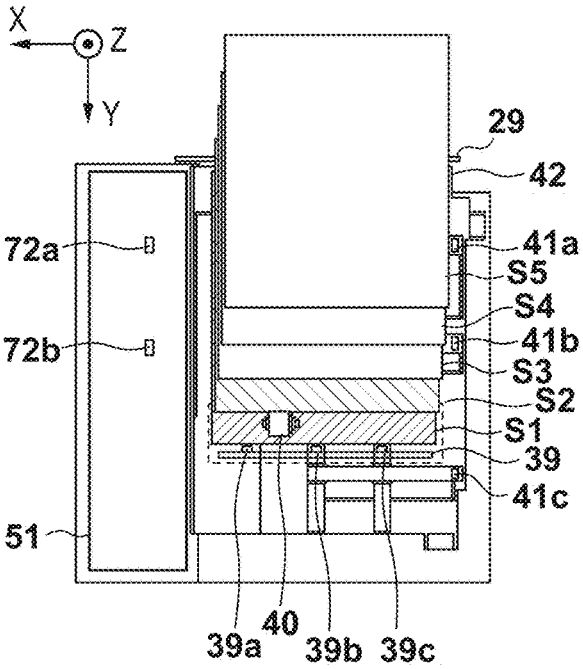

FIG. 4B illustrates the back end of the first sheet S1 having passed the nip of the kick-out roller 29, and the front end of the sheet S1 arriving at the vertical alignment roller 40. The sheet S1 abuts the vertical alignment plate 39 and is aligned using the position of the vertical alignment plate 39 as the reference. By continuously rotating the vertical alignment roller 40, following on from the sheet S1, the sheets S2 to S5 arriving at the vertical alignment roller 40 are abutted in order with the vertical alignment plate 39. Accordingly, the five sheets S1 to S5 are aligned in the Y direction (vertical direction) using the position of the vertical alignment plate 39 as the reference.

(4-3) Horizontal Alignment Stage

Figure 4C:
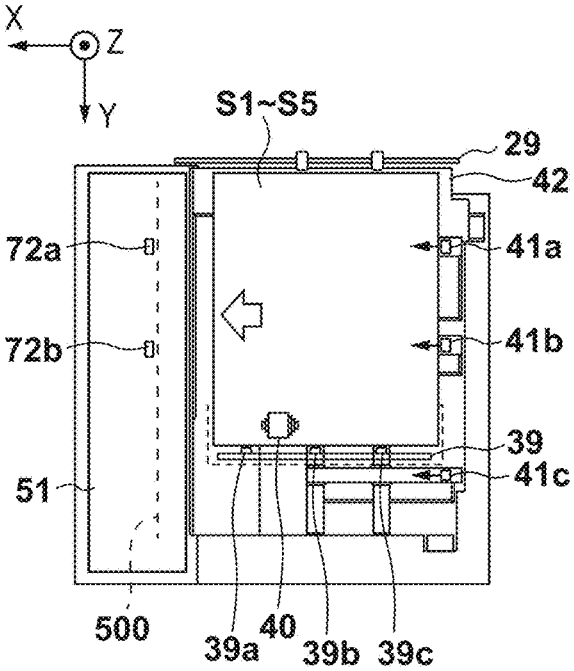

FIG. 4C illustrates alignment in the X direction (horizontal direction) having started after the alignment in the Y direction (vertical direction) of the sheets S1 to S5 has been completed. The horizontal alignment joggers 41*a* to 41*c* are driven in the X direction, the alignment direction, abutted against the side ends of the sheets S1 to S5, and push the sheets S1 to S5 toward the horizontal alignment plates 72*a* and 72*b*. Then, by abutting the other side ends of the sheets S1 to S5 against an abutting surface 500 of the horizontal alignment plates 72*a* and 72*b*, the sheets S1 to S5 are aligned in the X direction (horizontal direction) using the position of the horizontal alignment plates 72*a* and 72*b* as the reference.

(4-4) Bonding Stage (Thermocompression Bonding Stage)

Figure 4D:
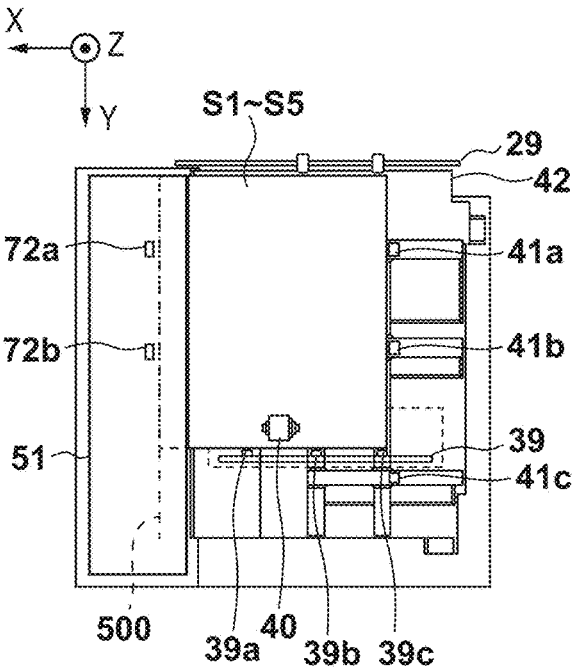

FIG. 4D illustrates the state when aligning the five sheets S1 to S5 in the X direction and the Y direction is complete. The target position (alignment position) in the alignment operation is the position of the sheet bundle W for when the bonding process (thermocompression bonding) is performed by the thermocompression bonding unit 51. As described above, the image forming apparatus 100 applies the adhesive toner Tn to the sheets S1 to S5 so that the side where the adhesive toner image is formed is on the side of the thermocompression bonding unit 51. In a case where the sheet S1 is the cover of the booklet, the adhesive toner Tn is not applied.

The thermocompression bonding unit 51 performs the thermocompression bonding operation on the sheets S1 to S5 after alignment is complete. During this time, the horizontal alignment joggers 41*a* to 41*c* retract in the −X direction. Accordingly, the intermediate stacker 42 is put in a state in which the next plurality of sheets S can be received. Thereafter, the sheet bundle W including the sheets S6 to S10 generated at the buffering portion 80 are stacked on the sheets S1 to S5.

Thereafter, the four stages described above are repeated for the sheets S1 to S10. Accordingly, the sheets S1 to S10 are bonded in a highly-accurately aligned state.

As an example, the sheet bundle W includes five sheets S. However, the number of the sheets S forming the sheet bundle W may be two, three, or the like. In other words, the number of the sheets S included in the sheet bundle W is equal to or less than the maximum number of the sheets S that can be layered at the buffering portion 80.

(5) Thermocompression Bonding Unit

Figure 5A:
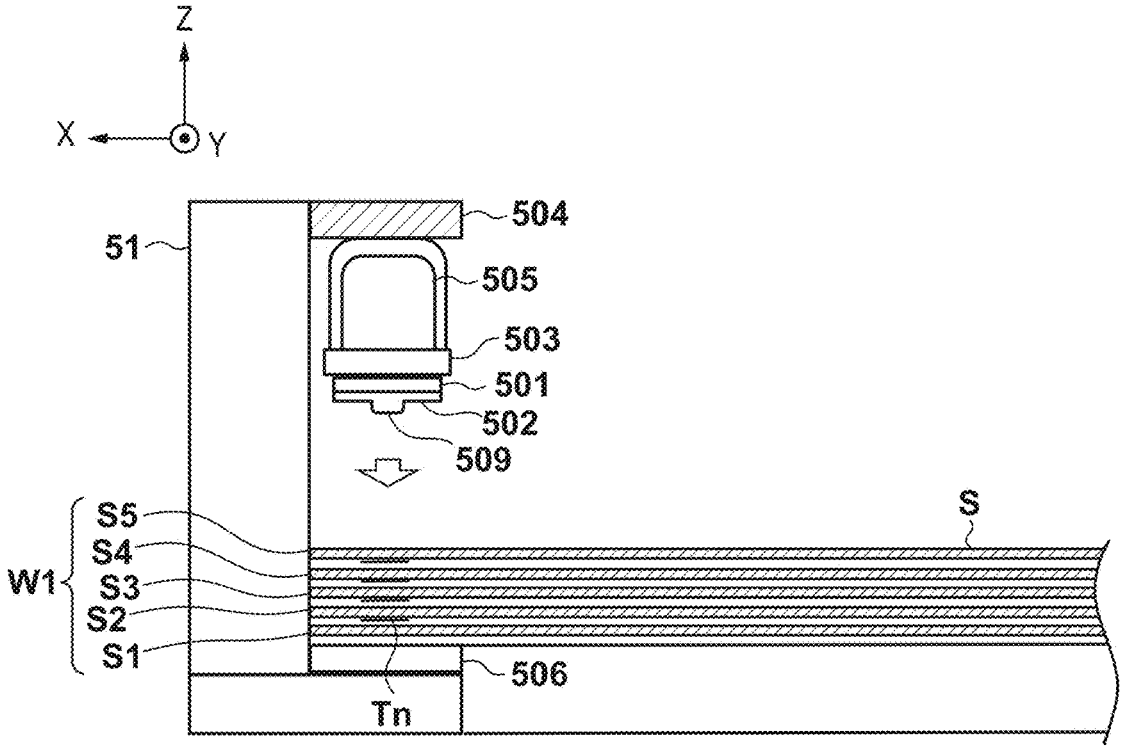
FIGS. 5A and 5B are diagrams for describing a bonding operation.

As illustrated in FIG. 5A, the thermocompression bonding unit 51 includes a heater 501 with an inbuilt heating element as a heat source and a heating plate 502 made of aluminum disposed above the heater 501. The heater 501 is a ceramic heater, for example. The temperature of the heater 501 may be controlled by a control circuit so that the temperature is measured by a temperature sensor and the measured temperature is at a target temperature. For example, the target temperature is set so that the surface temperature of a pressing portion 509 of the heating plate 502 is 200° C. By the heating plate 502 being provided with the pressing portion 509, the heat and pressure of the thermocompression bonding unit 51 can be concentrated at the binding position of the sheet bundle W. As a result, the heating and pressing efficiency is improved.

The heater 501 is supported by a heater support 503 made of resin. A press lever 504 obtains power from a motor M8 illustrated in FIG. 6 to push the thermocompression bonding unit 51 down in the −Z direction (downward direction) and press the sheet bundle W. The pressing force of the press lever 504 is transmitted to the pressing portion 509 via a metal stay 505 functioning as a rigid body. The pressing force of the press lever 504 can be controlled according to the amount the press lever 504 is moved in the −Z direction (downward direction). For example, the pressing force is 30 kgf.

A pressing plate 506 is made of an elastic material (for example, silicone rubber). This is because the pressing plate 506 is a member for stably receiving the pressing force. The thermocompression bonding unit 51 pressing the sheet bundle W1 including the sheets S1 to S5 and thereafter separates from the sheet bundle W1. The sheets S1 to S5 illustrated in FIG. 5A are the first to fifth sheets of a booklet corresponding to the product. The sheet S1 is the cover of the booklet. Thus, an image of the adhesive toner Tn is not formed on the sheet S1. An image of the adhesive toner Tn is formed on the lower surface of the second sheet onward from S2 to S5 of the booklet.

Figure 5B:
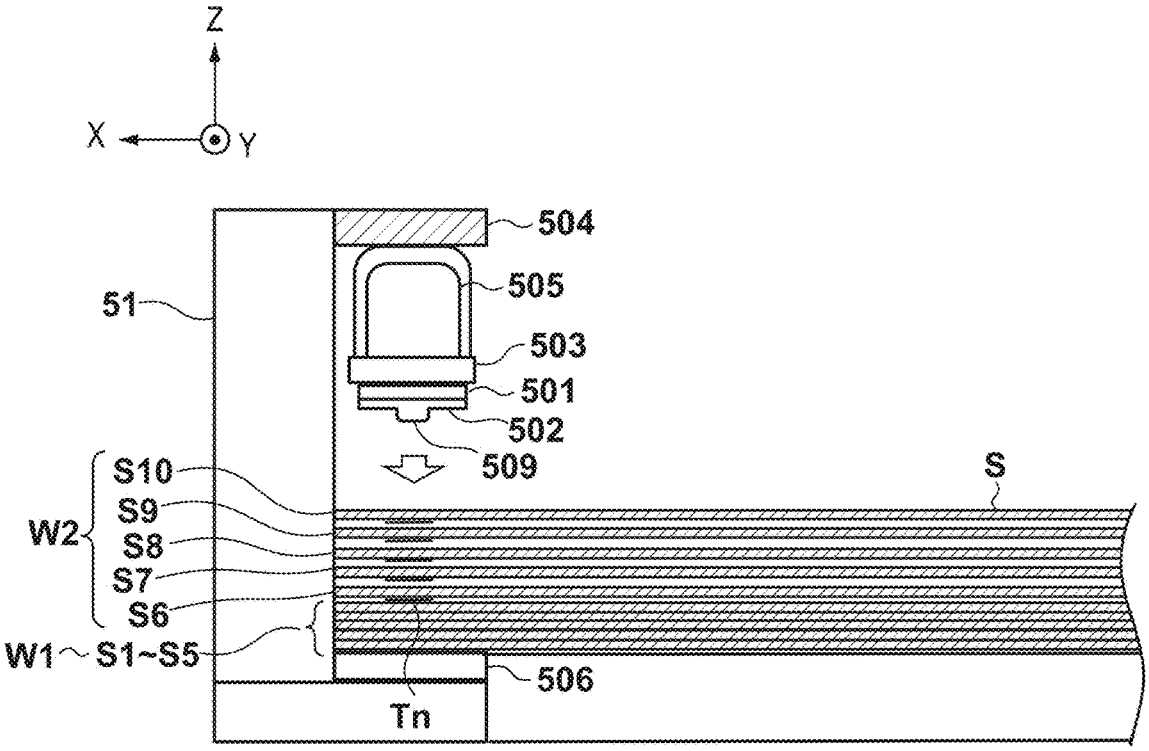

As illustrated in FIG. 5B, the sheet bundle W2 is stacked on the post-thermocompression-bonding sheets S1 to S5. The sheet bundle W2 includes the sheets S6 to S10. The thermocompression bonding unit 51 performs the thermocompression bonding operation on the sheet bundle W2 stacked on the sheet bundle W1. Accordingly, a booklet including many sheets S is prepared.

The sheets S6 to S10 stack after are included in the same booklet as the sheets S1 to S5. Thus, an image of the adhesive toner Tn is formed on each lower surface of the sheets S6 to S10.

As an example, the post-processing apparatus 300 can create a part of a booklet including a maximum of 100 sheets S. When booklet creation starts, the buffering portion 80 buffers the sheets S at a maximum of five at a time, creates the sheet bundle W, and then supplies the sheet bundle W to the intermediate stacker 42. The thermocompression bonding unit 51, each time the sheet bundle W arrives, performs the thermocompression bonding operation including the lowering operation, the pressing operation, and the raising operation. By repeating the buffering operation and the thermocompression bonding operation, booklets are efficiently created without a decrease in the productivity of the image forming apparatus 100.

When the thermocompression bonding operation on the sheet bundle W including the last page of the booklet is completed at the intermediate stacker 42, the vertical alignment plate 39 moves from the standby position to the discharge position. In other words, by the vertical alignment plate 39 moving in a translational manner toward the discharge opening 46, the completed booklet is pushed out. The discharge opening 46 is provided with the discharge rollers 38. When the front end of the booklet moves just past the discharge rollers 38, the vertical alignment plate 39 stops and then returns to the standby position. The discharge rollers 38 discharge the booklet to the lower tray 37.

(6) Controller

Figure 6:
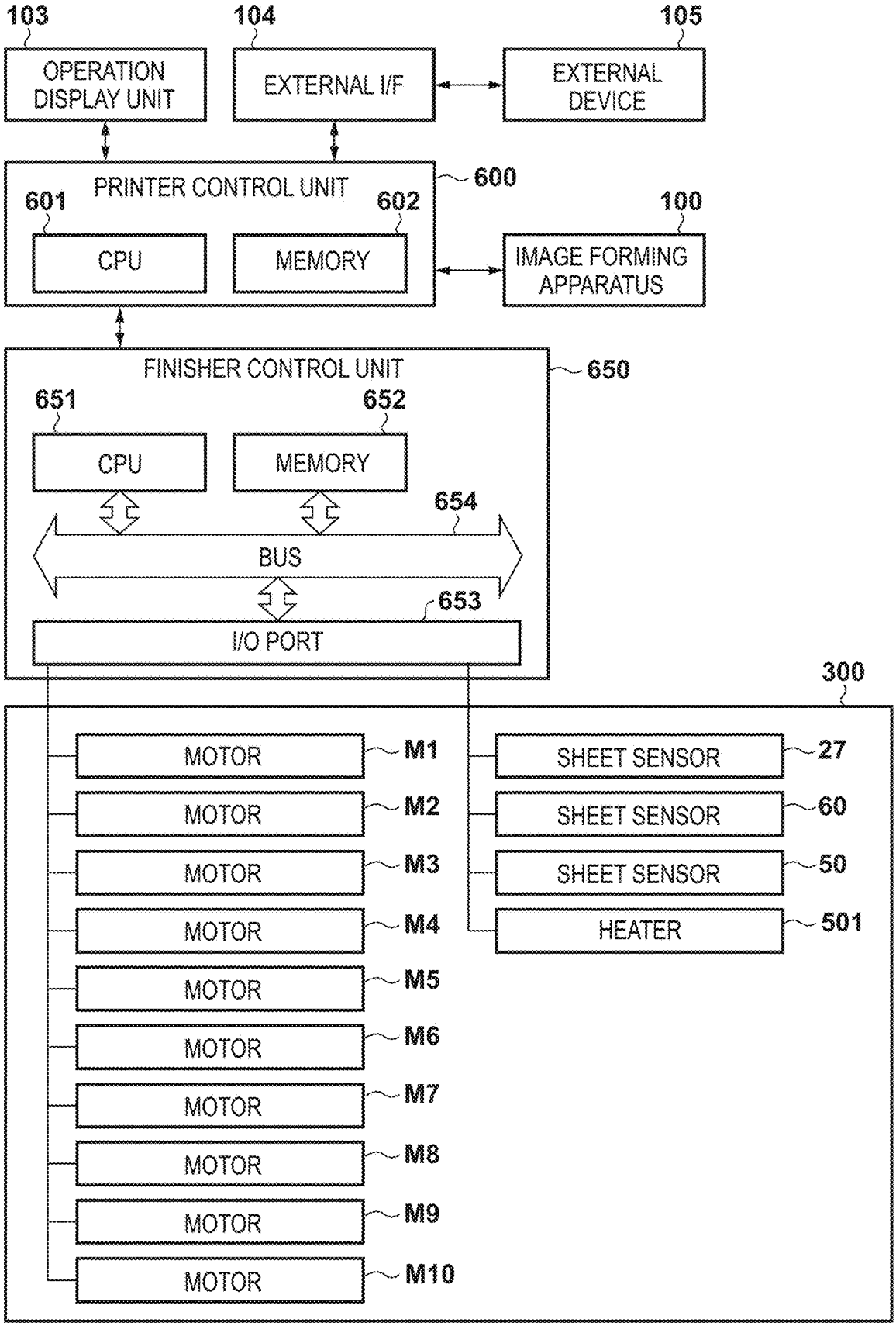
FIG. 6 is a diagram for describing a controller.

FIG. 6 is a diagram for explaining the controller of the image forming system 1. A printer control unit 600 is a controller that controls the image forming apparatus 100. A finisher control unit 650 is a controller that controls the post-processing apparatus 300. The printer control unit 600 and the finisher control unit 650 are connected via a communication interface and cooperate to control the operations of the image forming system 1.

The printer control unit 600 includes a central processing unit (CPU) 601 and a memory 602. The CPU 601 reads out and executes a program stored in the memory 602 and controls the image forming apparatus 100 according to the program. The CPU 601 performs an image forming process, a sheet conveying process, and the like for the image forming apparatus 100. The memory 602 includes a non-volatile storage medium such as a read-only memory (ROM) and a volatile storage medium such as a random-access memory (RAM). The memory 602 stores programs and data and provides a working area when the CPU 601 executes a program. The memory 602 is an example of a non-transitory storage medium storing a program for controlling the image forming apparatus 100.

The printer control unit 600 is connected to an external device 105 such as a personal computer, a portable information device via an external interface (I/F) 104. The printer control unit 600 accepts image forming job execution commands for the image forming system 1 input from the external device 105, for example. The printer control unit 600 is connected to an operation display unit 103, which is a user interface of the image forming system 1. The operation display unit 103 includes a display apparatus (for example, a liquid crystal panel that presents information to the user) and an input apparatus (for example, a physical button or touch sensor that accepts input operations from the user). The printer control unit 600, by communicating with the operation display unit 103, controls the display content of the display apparatus and receives the information input via the input apparatus.

The finisher control unit 650 includes a CPU 651, a memory 652, and an I/O port 653. The CPU 651 reads out and executes a program stored in the memory 652 and controls the post-processing apparatus 300 according to the program. The memory 652 includes a non-volatile storage medium (for example, ROM, SSD, or HDD) and a volatile storage medium (for example, RAM). SSD is an abbreviation for a solid state drive. HDD is an abbreviation for a hard disk drive. The memory 652 stores programs and data and provides a working space when the CPU 651 executes a program. The memory 652 is an example of a non-transitory storage medium storing a program for controlling the post-processing apparatus 300. The CPU 651, the memory 652, and the I/O port 653 are connected to one another via a bus 654. The I/O port 653 outputs control signals to various components of the post-processing apparatus 300 and is input with signals from the various components.

Note that each function of the printer control unit 600 and the finisher control unit 650 may be implemented as a piece of independent hardware such as an ASIC or may be implemented via software as a program module. ASIC is an abbreviation for an application-specific integrated circuit. The printer control unit 600 may have a part of or all of the functions of the finisher control unit 650.

The sheet sensors 27, 50, and 60 and the heater 501 are connected to the I/O port 653. Motors M1 to M10, which are the drive source for conveying the sheets S and the drive source for the thermocompression bonding unit 51, are connected to the I/O port 653.

The motor M1 rotationally drives the inlet roller 21. The motor M2 rotationally drives the conveyance roller pair 22. The motor M3 rotationally drives the conveyance roller pair 24. The motor M4 rotationally drives the conveyance roller pair 26. The motor M5 rotationally drives the kick-out roller 29. The motor M6 supplies the driving force to intermittently operate the vertical alignment roller 40 one rotation at a time. The motor M7 moves the horizontal alignment joggers 41 in the +X direction or the −X direction. The motor M8 drives the operation of the thermocompression bonding unit 51 to press the sheet bundle W. The motor M9 rotationally drives the discharge rollers 38. The motor M10 drives the vertical alignment plate 39 in the +Y direction or the −Y direction.

(7) Functional Configuration

Figure 7:
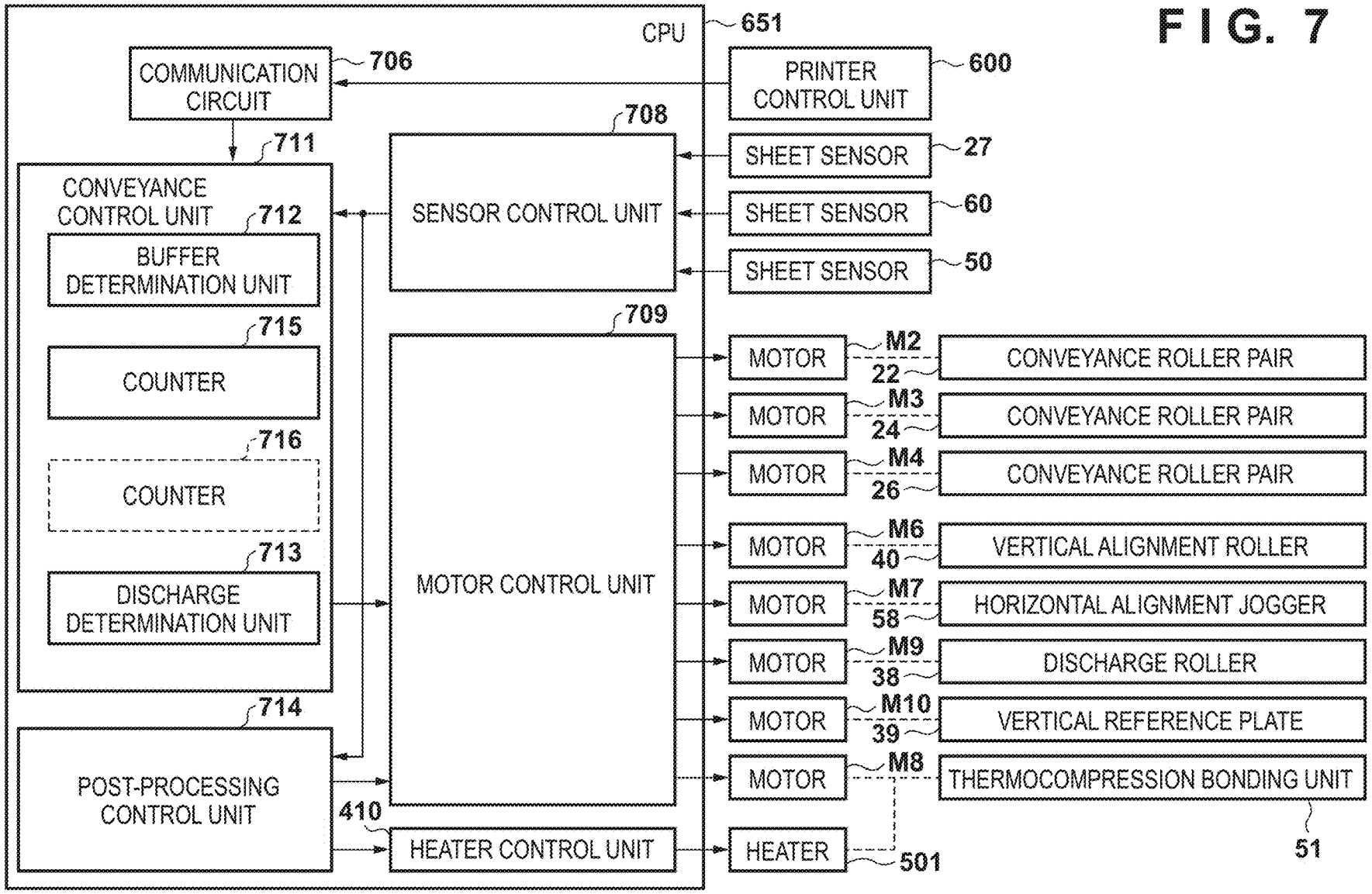
FIG. 7 is a diagram for describing functions of a CPU.

FIG. 7 illustrates the functions implemented by the CPU 651. The CPU 651, according to a program, implements a sensor control unit 708, a motor control unit 709, a heater control unit 710, and a conveyance control unit 711. At least one of or all of the functions may be realized by an ASIC, a digital signal processor (DSP), a field programmable gate array (FPGA), or the like. The CPU 651 may include a communication circuit 706 for executing serial communications and the like.

The communication circuit 706 is connected to the printer control unit 600 and receives job information and information relating to the sheets S conveyed from the image forming apparatus 100. The communication circuit 706 also instructs the printer control unit 600 to temporarily stop image forming jobs.

The sensor control unit 708 activates the sheet sensors 27, 50, and 60 and passes the signals input from the sheet sensors 27, 50, and 60 to the conveyance control unit 711. The conveyance control unit 711 instructs the motor control unit 709 to drive the motors M1 to M5 mainly on the basis of input from the sensor control unit 708. Accordingly, conveyance control of the sheets S, the sheet bundle W, and the booklet is implemented. On the basis of input from the sensor control unit 708, a post-processing control unit 714 instructs the motor control unit 709 to drive the motors M6 to M10 and instructs the heater control unit 710 to start the heating of the heater 501. Accordingly, post-processing including a vertical alignment process, a horizontal alignment process, a thermocompression bonding operation, and the like is implemented.

The conveyance control unit 711 includes a buffer determination unit 712 and a discharge determination unit 713. The buffer determination unit 712 determines the division between the preceding sheet bundle and the subsequent sheet bundle at the buffering portion 80. The discharge determination unit 713 may determine the division between the preceding booklet and the subsequent booklet. The buffer determination unit 712 determines the number of the sheets S included in the sheet bundle W formed at the buffering portion 80 to determine the division between the preceding sheet bundle and the subsequent sheet bundle, for example. The discharge determination unit 713 may determine the division between the preceding booklet and the subsequent booklet by determining to discharge a booklet held at the intermediate stacker 42. A counter 715 counts a number i of the sheets S stacked at the buffering portion 80. A counter 716 is used in the second embodiment and counts a number H of sheets stacked at the intermediate stacker 42.

(8) Continuously Creating Multiple Booklets

The image forming system 1 can continuously create multiple booklets. When job information is received by the conveyance control unit 711 from the external device 105 via the communication circuit 706, the conveyance control unit 711 obtains a total number U of pages included in the job. Here, it is premised that the total number U is not greater than an upper limit number Q (for example, Q=100 sheets) of the sheets S that can be stacked at the intermediate stacker 42. Also, the number of the sheets S included in one booklet is defined as M. The upper limit number of the sheets S included in the sheet bundle W created at the buffering portion 80 is defined as N.

Figure 8:
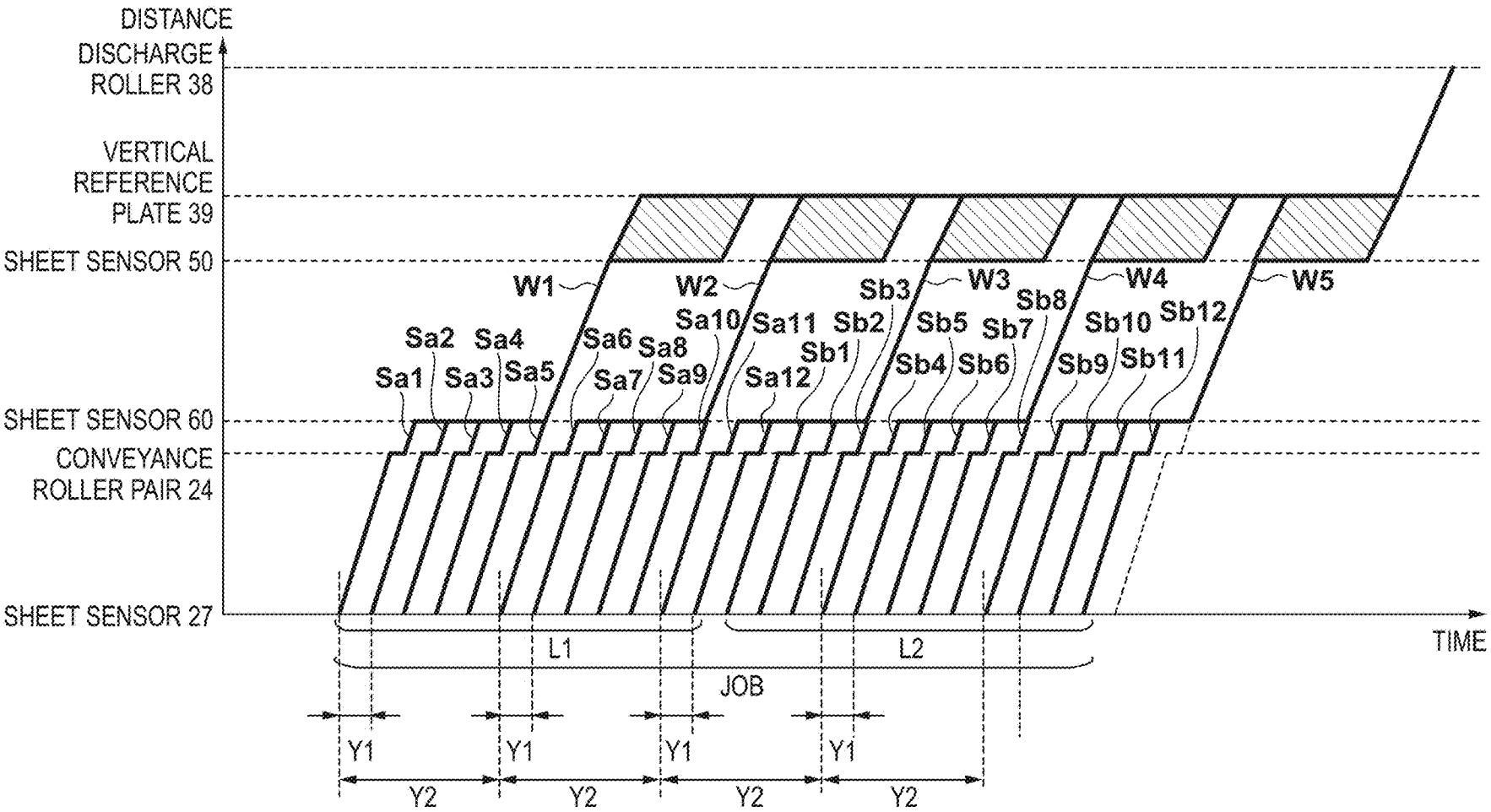
FIG. 8 is a timing chart according to a first embodiment.

FIG. 8 is a conveyance diagram of the sheets S for a job for creating two booklets L1 and L2 in which M equals twelve sheets. N is five sheets. The horizontal axis represents time. The vertical axis represents the distance along the conveying path in the post-processing apparatus 300 using the inlet roller 21 as the origin point. The positions of the front end of the sheet S are plotted in FIG. 8.

The sheet S is fed from the image forming apparatus 100 at a constant cycle. The buffering portion 80 forms the sheet bundle W including five sheets S and sends the sheet bundle W to the intermediate stacker 42. The intermediate stacker 42 performs post-processing (alignment and compression bonding) each time the sheet bundle W arrives.

The operation described above is repeated, and the booklets L1 and L2 are completed at the intermediate stacker 42. Thereafter, the discharge rollers 38 discharges the booklets L1 and L2 together to the lower tray 37.

Note that on the downstream side of the conveyance roller pair 24, the conveyance direction of the sheet S is changed by a switch back. In other words, the front end of the sheet S is changed from the first end to the second end. Thus, after the sheet S has temporarily stopped at the conveyance roller pair 24, the position of the front end of the sheet S in FIG. 8 is the position of the second end.

In FIG. 8, sheets Sa1 to Sa5 are buffered at the buffering portion 80 and form the sheet bundle W1. The sheet bundle W1 is conveyed to the intermediate stacker 42 where the front ends of the sheets Sa1 to Sa5 are vertically aligned by the vertical alignment plate 39. Also, the horizontal alignment process and the thermocompression bonding operation are performed on the sheets Sa1 to Sa5.

In FIG. 8, the buffering operation at the buffering portion 80 is represented by the subsequent sheet S overlapping the preceding sheet S waiting at the position of the sheet sensor 60. The second sheet bundle W2 to the fifth sheet bundle W5 are also conveyed, aligned, and compression-bonded in a similar manner to the sheet bundle W1. The conveyance interval (sheet interval) of the sheets S is Y1. The conveyance interval of the sheet bundles W is Y2.

The sheet bundle W1 is held at the intermediate stacker 42 after being thermocompression-bonded at the intermediate stacker 42. The subsequent sheet bundles W2 to W5 are stacked in order on the sheet bundle W1. When the thermocompression bonding operation is performed on the sheet bundles W2 to W5, the sheet bundle W1 receives the thermocompression bonding operation. The sheet bundles W2 to W4 likewise receive the thermocompression bonding operation a plurality of times. Thus, as illustrated in FIG. 8, the front end position of the sheet bundles W1 to W4 remains halted at the position of the vertical alignment plate 39.

The maximum number of the sheets S included in the sheet bundle Wis five. Thus, the last sheet Sa12 of the booklet L1 and the first sheet Sb1 of the booklet L2 are included in the sheet bundle W3. As illustrated in FIG. 8, the sheet bundle W3 includes the sheets Sa11 and Sa12 of the booklet L1 and the sheets Sb1, Sb2, and Sb3 of the booklet L2.

The total number U of the sheets S in the job is 24, and this is not a multiple of N. Thus, the last sheet bundle W5 includes the four sheets Sb9 to Sb12, with four being less than N.

Figure 9:
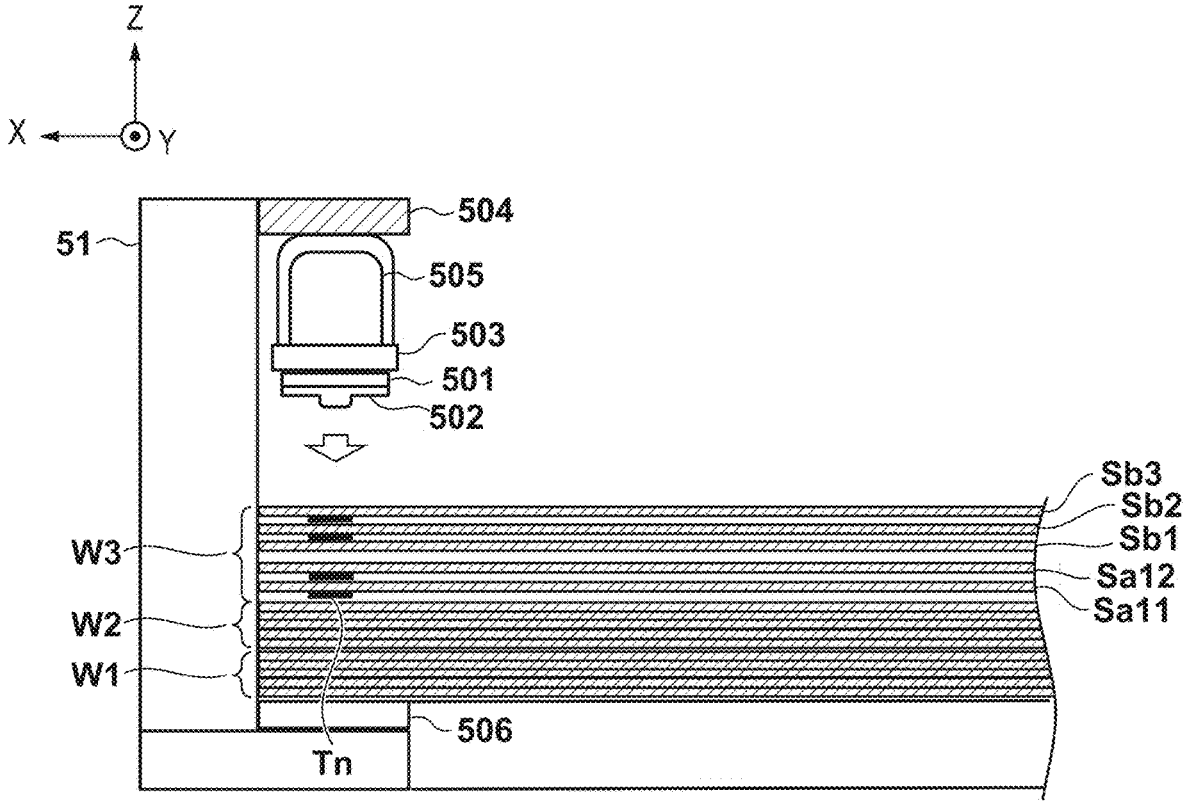
FIG. 9 is a diagram for describing a bonding operation.

FIG. 9 is a cross-sectional view of the thermocompression bonding unit 51 at the point in time when the sheet bundle W3 is received at the thermocompression bonding unit 51. The adjacent sheets S included in the sheet bundles W1 and W2 have already been bonded. An image from the adhesive toner Tn has not been formed on the sheet Sb1 corresponding to the cover of the booklet L2. Thus, even is the thermocompression bonding operation is performed in this state, the sheet Sa12 of the booklet L1 and the sheet Sb1 of the booklet L2 will not be bonded.

However, the sheets Sa11 and Sa12 conveyed as part of the sheet bundle W3 are bonded to the sheet bundles W1 and W2 stacked below. In this manner, the booklet L1 is completed, and the booklets L1 and L2 are separated from one another.

As illustrated in FIG. 8, when the thermocompression bonding operation of the sheet bundle W4 and the thermocompression bonding operation of the sheet bundle W5 end, the stacked booklets L1 and L2 are pushed by the vertical alignment plate 39 toward the discharge rollers 38. Finally, the booklets L1 and L2 are discharged together to the lower tray 37.

(9) Flowchart

Figure 10A:
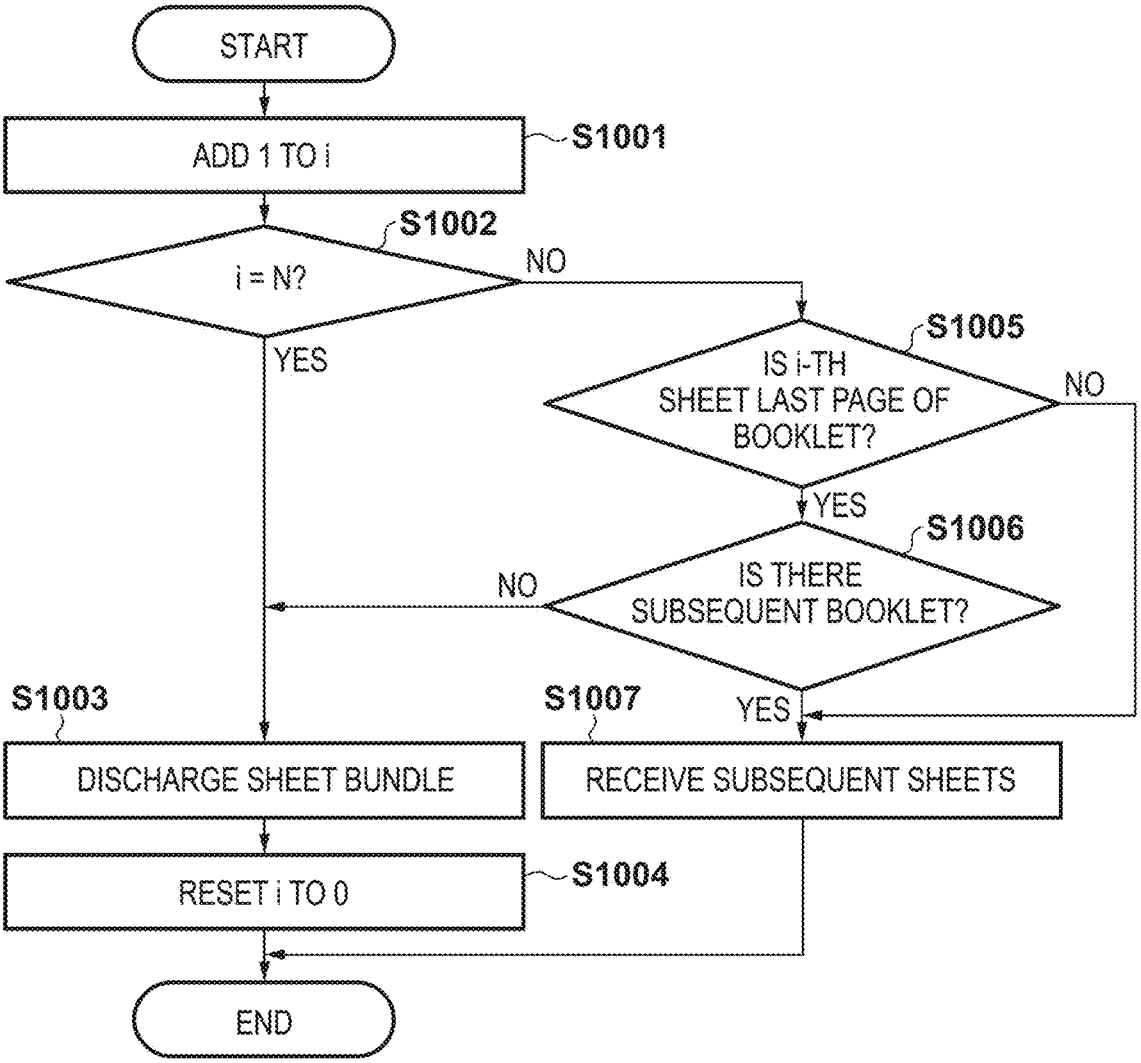
FIGS. 10A and 10B are flowcharts illustrating the first embodiment.

FIG. 10A illustrates the process performed by the CPU 651 (buffer determination unit 712). When the sheet sensor 27 detects the back end of the sheet S, the following processes are performed.

In S1001, the CPU 651 adds one to the count value i of the counter 715 counting the number of the sheets S held at the buffering portion 80. The count value i is initialized to zero when an image forming job is started and when the sheet bundle W is discharged from the buffering portion 80 to the intermediate stacker 42.

In S1002, the CPU 651 determines whether the count value i equals the upper limit number N. In other words, whether the number (count value i) of the sheets S being buffered at the buffering portion 80 is equal to the upper limit number N is determined. In other words, whether or not the sheet bundle Wis complete is determined. In a case where the count value i is equal to N, the CPU 651 advances the process from S1002 to S1003.

In S1003, the CPU 651 discharges the sheet bundle W from the buffering portion 80 to the intermediate stacker 42. In other words, the CPU 651 drives the conveyance roller pairs 26 and 28 and the kick-out roller 29 and conveys the sheet bundle W to the intermediate stacker 42. In S1004, the CPU 651 clears the count value i of the counter 715 to zero.

However, in a case where the count value i is less than N in S1002, the CPU 651 advances the process from S1002 to S1005. In S1005, on the basis of the information of the sheet S obtained by the communication circuit 706, the CPU 651 determines whether or not the sheet S input to the buffering portion 80 corresponds to the last page of a booklet. In a case where the sheet corresponds to the last page of a booklet, the CPU 651 advances the process from S1005 to S1006.

In S1006, the CPU 651 determines whether a subsequent booklet exists on the basis of the job information. Note that the finisher control unit 650 is notified of the job information of the subsequent booklet in advance by the communication circuit 706. In a case where a subsequent booklet does not exist, the sheet bundle W is complete, and thus the CPU 651 advances the process from S1006 to S1003. In other words, the sheet bundle W is discharged from the buffering portion 80 and conveyed to the intermediate stacker 42.

On the other hand, in a case where a subsequent booklet does exist, the CPU 651 advances the process from S1006 to S1007. In S1007, the CPU 651 continues to receive subsequent sheets at the buffering portion 80. In other words, the buffering operation continues.

Figure 10B:
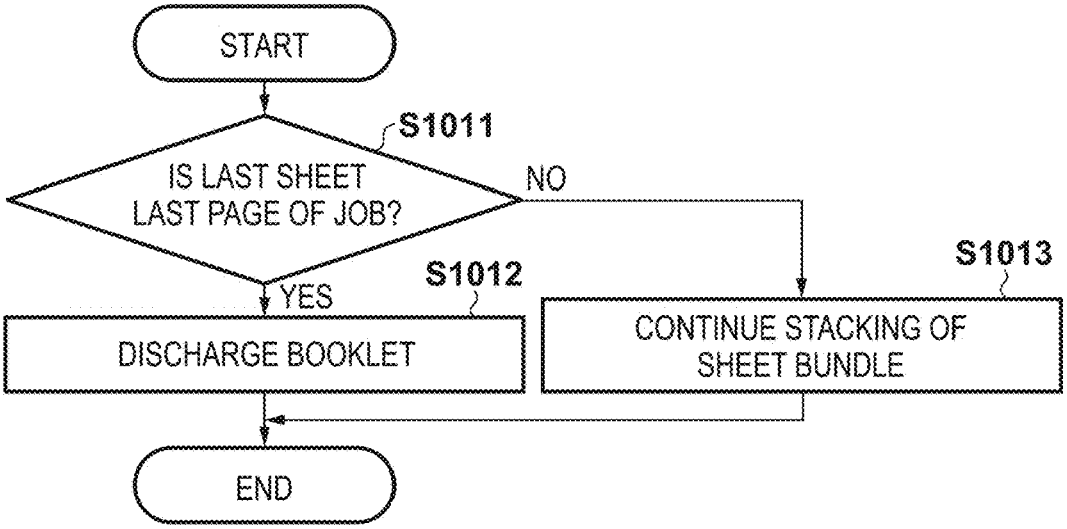

FIG. 10B illustrates the determination process performed by the CPU 651 (discharge determination unit 713). When the sheet sensor 50 detects the back end of the sheet bundle W, the following processes are performed.

In S1011, the CPU 651 determines whether the sheet S (last buffered) located at the top in the sheet bundle W is the last page of the job. In a case where the sheet is the last page of the job, the CPU 651 advances the process from S1011 to S1012.

In S1012, since the post-processing on the sheet bundle W has ended and the booklet creation is complete, the CPU 651 discharges the booklet from the intermediate stacker 42 to the lower tray 37. The CPU 651 drives the motor M10 and pushes the booklet with the vertical alignment plate 39. Also, the CPU 651 drives the motor M9, rotates the discharge rollers 38, and discharges the booklet to the lower tray 37.

On the other hand, in step S1011, in a case where the last sheet S of the sheet bundle W is not the last page of the job, the CPU 651 advances the process from S1011 to S1013.

In S1013, the CPU 651 continues holding the sheet bundle W at the intermediate stacker 42 and continues stacking the subsequent sheet bundle W.

According to the first embodiment, in the job for continuously creating a plurality of booklets, the thermocompression bonding operation can be performed on the subsequent booklet L2 without discharging the booklet L1 from the intermediate stacker 42. Accordingly, booklets can be continuously created without a decrease in the productivity of the image forming system 1.

Second Embodiment

The first embodiment is premised on the total number U (for example, 24 sheets) of the sheets S included in a plurality of booklets stacked at the intermediate stacker 42 not exceeding the upper limit number Q (for example, 100 sheets) of the sheets S that can be stacked at the intermediate stacker 42. In the second embodiment, how a case in which the total number U (for example, 104 sheets) exceeds the upper limit number Q (for example, 100 sheets) is handled will be described. In particular, a method will be described for continuously creating booklets while staying within the constraint relating to the upper limit number Q in a case where information relating to the total number U of the sheets S for the job cannot be obtained by the conveyance control unit 711.

Figure 11:
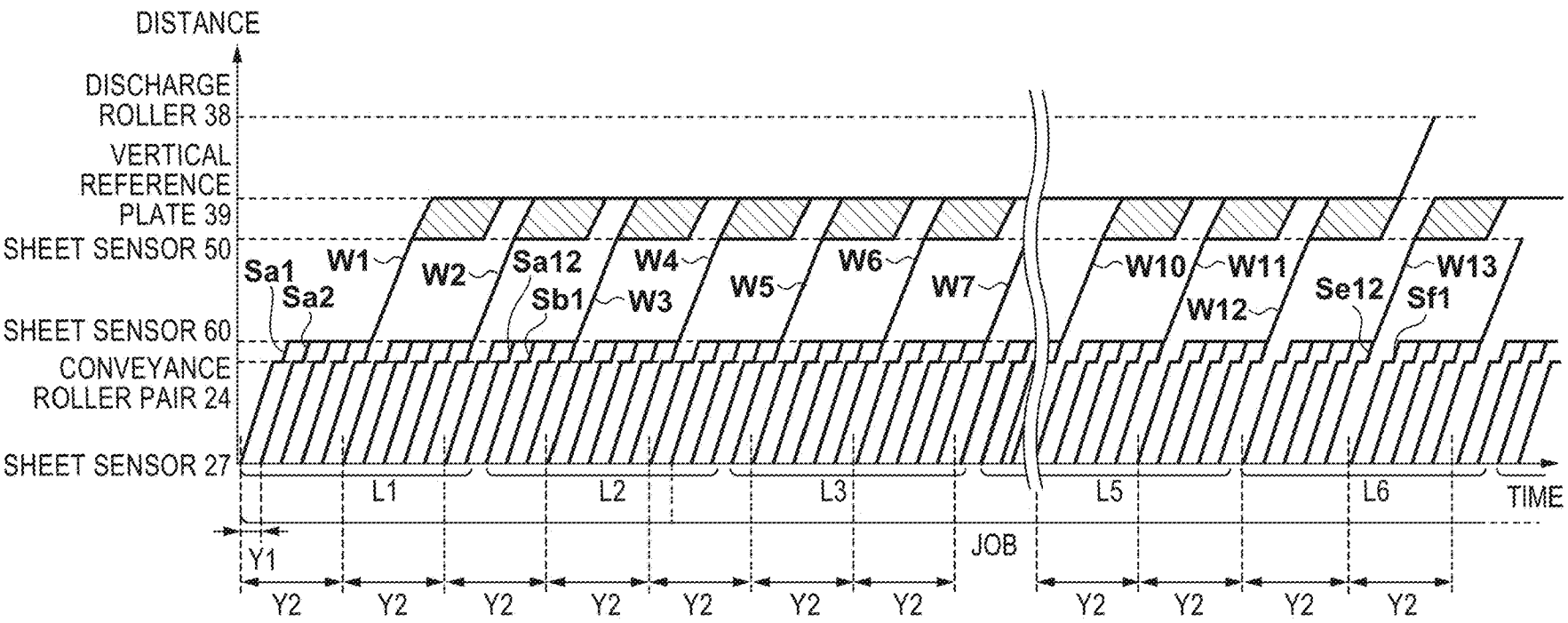
FIG. 11 is a timing chart according to a second embodiment.

FIG. 11 illustrates a conveyance diagram of a case in which six or more booklets are created with each booklet including twelve sheets S. The description of FIG. 11 is basically the same as the description of FIG. 8A. However, from the perspective of clarity, in FIG. 11, the reference signs for the sheets S and the notation of the conveyance intervals Y1 are abbreviated. In FIG. 11, the booklets L1 to L6 are illustrated. However, the conveyance control unit 711 has not obtained information relating to the total number U for the job.

In such a case, a process of the conveyance control unit 711 forming the sheet bundle W including five sheets S at the buffering portion 80 and sending the sheet bundle W to the intermediate stacker 42 where the thermocompression bonding operation is performed is repeated. Here, the sheet Se12 corresponding to the last page of the twelfth sheet bundle W12 is the last page of the fifth booklet L5. The sheet Se12 satisfies the condition of S1011 in the flowchart illustrated in FIG. 10B. When the booklet L5 is completed at the intermediate stacker 42, the five booklets L1 to L5 are discharged together to the lower tray 37.

As illustrated in FIG. 11, this is continuously followed by the creation of the booklet L6, and the sheet bundle W13 is conveyed to the intermediate stacker 42 in an empty state. The same operation as performed on the sheet bundles W1 to W12 is also performed on the sheet bundle W13. Accordingly, in a case where, before the upper limit number Q for the sheets S that can be stacked at the intermediate stacker 42 is reached, the last sheet S of the sheet bundle W corresponds to the last sheet S of the booklet L, all of the booklets stacked at the intermediate stacker 42 are discharged to the lower tray 37. In this manner, before a number R (for example, 60 sheets) of the sheets S stacked at the intermediate stacker 42 exceeds the upper limit number Q of the intermediate stacker 42, if a multiple of the total number M (for example, 12 sheets) and a multiple of the upper limit number N (for example, five sheets) of the buffering portion 80 is used, no problem occurs.

Figure 12:
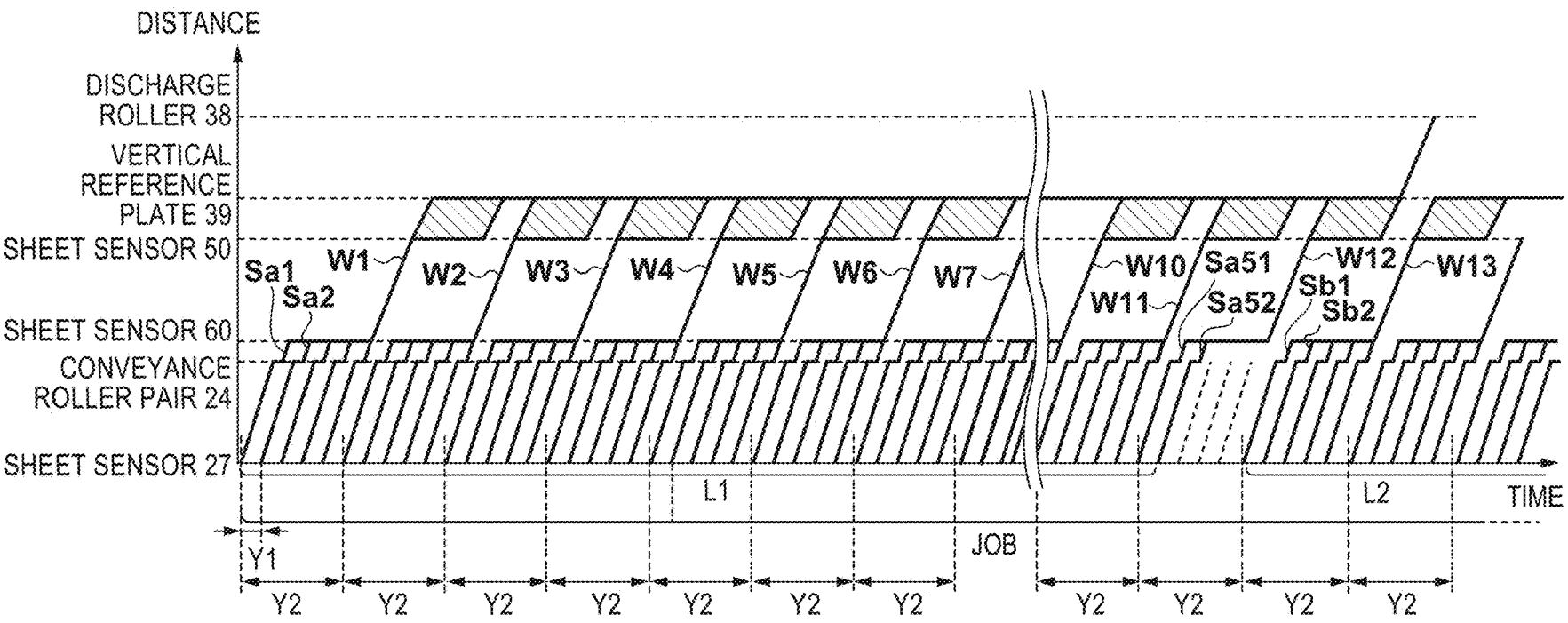
FIG. 12 is a timing chart according to the second embodiment.

FIG. 12 illustrates a case in which the booklets L1 and L2 are continuously created with M equaling 52 sheets. Here, the sheet Sa52 corresponding to the last page of the eleventh sheet bundle W11 is the last page of the booklet L1. This example is premised on the sheet bundle W11 including the sheet Sb1 of the subsequent booklet L2 and the sheet Sa52 being formed and sent to the intermediate stacker 42. In this case, the booklet L1 cannot be discharged from the intermediate stacker 42 until the booklet L2 is completed. If the booklet L2 is a booklet including 52 sheets S, the number R of the sheets S stacked at the intermediate stacker 42 becomes 104 sheets, which is a value greater than the upper limit number Q.

Thus, the sheet Sb1 and the sheet Sa52 cannot be included in the same sheet bundle W11. In other words, the sheet bundle W11 including the sheet Sa51 and the sheet Sa52 is conveyed to the intermediate stacker 42. When the booklet L1 is completed, the booklet L1 is discharged to the lower tray 37. Note that the interval between the last sheet bundle W11 of the booklet L1 and the first sheet bundle W12 of the booklet L2 needs to be Y2. Here, the conveyance control unit 711 notifies the image forming apparatus 100 via the communication circuit 706 that the sheet interval between the sheet Sa52 and the sheet Sb1 needs to be 4×Y1.

Figure 13:
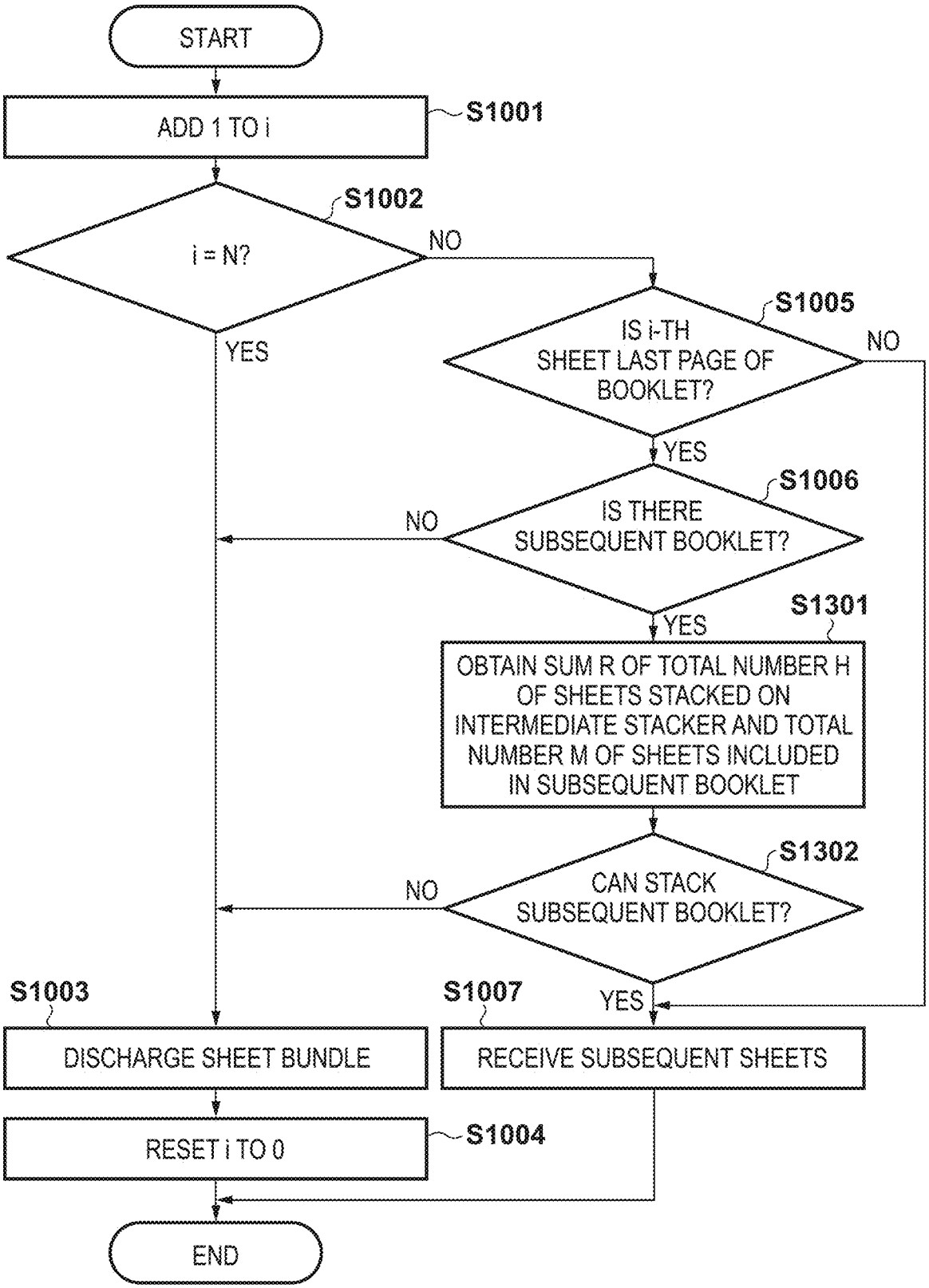
FIG. 13 is a flowchart illustrating a method for determining discharge from a buffering portion.

FIG. 13 illustrates a method for determining the division between the sheet bundles W performed according to a program by the CPU 651. Compared to FIG. 10A, in FIGS. 13, S1301 and S1302 are added between S1006 and S1007. Thus, S1301 and S1302 will be the focus of the following description. The counter 716 counts the total number H of the sheets S stacked at the intermediate stacker 42.

Step S1301 is performed in the case of Yes in S1006. In S1301, the CPU 651 obtains a sum R of the total number H of the sheets S stacked at the intermediate stacker 42 and the total number M of the sheets S included in the subsequent booklet.

$$R=H+M \quad \text{Eq1}$$

In S1302, the CPU 651 determines whether the subsequent booklet can be stacked at the intermediate stacker 42 on the basis of the sum R and the upper limit number Q. If the sum R is equal to or less than the upper limit number Q, the CPU 651 determines that the subsequent booklet can be stacked and advances the process from S1302 to S1007. On the other hand, if the sum R is greater than the upper limit number Q, the CPU 651 determines that the subsequent booklet cannot be stacked and advances the process from S1302 to S1003.

Figure 14:
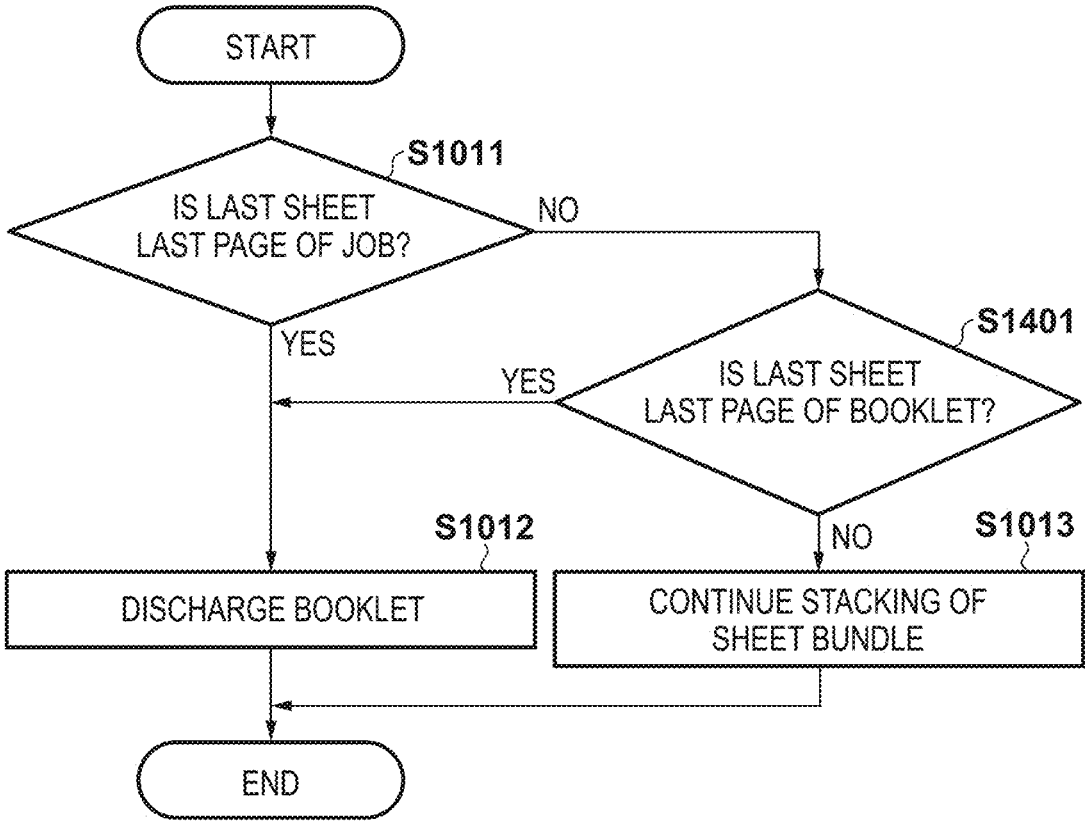
FIG. 14 is a flowchart illustrating a method for determining discharge from an intermediate stacker.

FIG. 14 illustrates a process for determining the discharge of a booklet from the intermediate stacker 42. Compared to FIG. 10B, in FIGS. 14, S1400 and S1401 are added. S1011 to S1013 have already been described and thus will not be described again.

In S1011, in a case where the last sheet of the sheet bundle W that has arrived at the intermediate stacker 42 is not the last page of the job, the CPU 651 advances the process from S1011 to S1401.

In S1401, the CPU 651 determines whether the last sheet of the sheet bundle W conveyed to the intermediate stacker 42 is the last page of a booklet. In a case where the last sheet of the sheet bundle W is the last page of a booklet, the CPU 651 advances the process from S1401 to S1012. In other words, all of the booklets stacked at the intermediate stacker 42 are discharged. This case includes both the case illustrated in FIG. 11 (case in which His a multiple of N) and the case illustrated in FIG. 12 (case in which H is not a multiple of N). On the other hand, in a case where the last sheet of the sheet bundle is not the last page of a booklet, the booklet is not yet complete. Then, the CPU 651 advances the process from S1401 to S1013. In this manner, the stacking of the subsequent sheet bundle at the intermediate stacker 42 continues.

According to the second embodiment, even when the total number of the sheets S for the job is unknown, booklets can be continuously formed. In other words, at the intermediate stacker 42, the sheets S are stacked within a stackable range. The sheets S forming the preceding booklet and the sheets S forming the subsequent booklet can be mixed in the same sheet bundle W and conveyed. As a result, booklets can be continuously created without a decrease in the productivity of the image forming system 1.

Third Embodiment

Figure 15:
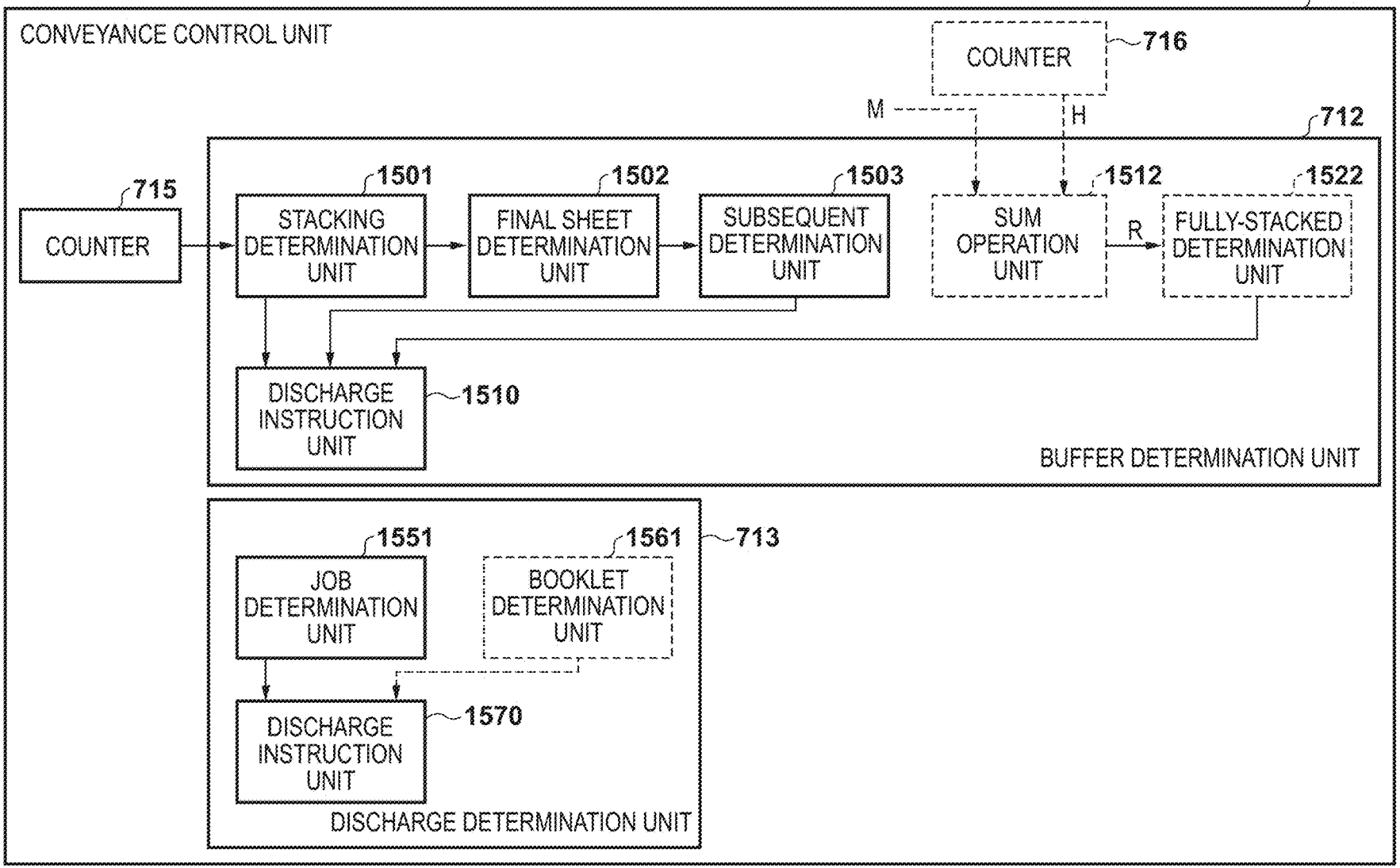
FIG. 15 is a diagram for describing functions of a CPU and a conveyance control unit.

FIG. 15 illustrates in detail the functions or modules included in the conveyance control unit 711 according to the first and second embodiment. The buffer determination unit 712 determines whether or not to allow the subsequent sheet S to be stacked at the buffering portion 80 on the basis of the count value i of the counter 715. For example, if i is less than N, the buffer determination unit 712 allows the subsequent sheet S to be stacked at the buffering portion 80. If i is equal to N, the buffer determination unit 712 determines to start discharging the sheet bundle W from the buffering portion 80 to the intermediate stacker 42. A discharge instruction unit 1510 instructs the motor control unit 709 to discharge the sheet bundle W from the buffering portion 80 to the intermediate stacker 42.

A final sheet determination unit 1502 analyzes the job information and determines whether or not the i-th sheet S stacked last at the buffering portion 80 is the last page (sheet) of the booklet. In a case where the i-th sheet S is the last page (sheet), a subsequent determination unit 1503 analyzes the job information and determines whether or not a subsequent booklet exists. In a case where the i-th sheet S is the last page (sheet) of the booklet and a subsequent booklet does not exist, the subsequent determination unit 1503 determines to start discharging the sheet bundle W from the buffering portion 80 to the intermediate stacker 42. As a result, the discharge instruction unit 1510 instructs the motor control unit 709 to discharge the sheet bundle W from the buffering portion 80 to the intermediate stacker 42.

Note that in a case where the i-th sheet S is not the last page (sheet) of the booklet, the subsequent sheet S is received at the buffering portion 80. In a case where the i-th sheet S is the last page (sheet) of the booklet and a subsequent booklet exists, the subsequent sheet S is received at the buffering portion 80.

In the second embodiment, in a case where the i-th sheet S is not the last page (sheet) of the booklet or the i-th sheet S is the last page (sheet) of the booklet and it is the subsequent booklet, another determination is added. In other words, whether or not the sheet bundle W can be discharged to the intermediate stacker 42 is determined.

A sum operation unit 1521 and a fully-stacked determination unit 1522 are functions relating to the second embodiment. The sum operation unit 1521 obtains the sum R by adding together the count value H of the counter 716 and the total number M of the sheets included in the subsequent booklet. The fully-stacked determination unit 1522 determines whether or not the sum R is equal to or less than the upper limit number Q of the sheets S that can be stacked at the intermediate stacker 42. In a case where the i-th sheet S is the last page (sheet) of the booklet and the sum R is equal to or less than the upper limit number Q, the fully-stacked determination unit 1522 determines to start discharging the sheet bundle W from the buffering portion 80 to the intermediate stacker 42. As a result, the discharge instruction unit 1510 instructs the motor control unit 709 to discharge the sheet bundle W from the buffering portion 80 to the intermediate stacker 42.

The discharge determination unit 713 of the first embodiment includes a job determination unit 1551 and a discharge instruction unit 1570. The job determination unit 1551 determines whether or not the last sheet S in the sheet bundle W that last arrived at the intermediate stacker 42 is the sheet S corresponding to the last page of the job on the basis of the job information. If the last sheet S is the sheet S corresponding to the last page of the job, the job determination unit 1551 determines to discharge all of the booklets stacked at the intermediate stacker 42. As a result, the discharge instruction unit 1570 instructs the post-processing control unit 714 or the motor control unit 709 to discharge the booklets.

The discharge determination unit 713 according to the second embodiment further includes a booklet determination unit 1561. The booklet determination unit 1561 determines whether the last sheet of the sheet bundle W conveyed to the intermediate stacker 42 is the last page of a booklet. The case of the last sheet of the sheet bundle W corresponding to the last page of the booklet is as described using FIGS. 11 and 12. When the booklet located at the top in the intermediate stacker 42 is completed, the booklet determination unit 1561 determines to discharge all of the booklets stacked at the intermediate stacker 42. As a result, the discharge instruction unit 1570 instructs the post-processing control unit 714 or the motor control unit 709 to discharge the booklets.

Technical Ideas Derived from Embodiments (Item 1)

The buffering portion 80 is an example of a bundling mechanism. The conveyance roller pairs 26 and 28 are examples of a conveyer. The intermediate stacker 42 is an example of a stacker. The thermocompression bonding unit 51 is an example of an adhesion mechanism. The discharge rollers 38 and the vertical alignment plate 39 are examples of a discharger. According to the first and second embodiments, the last sheet to be included in the preceding booklet and the first sheet to be included in the subsequent booklet are included in a single sheet bundle and conveyed. Also, a plurality of sheets forming one booklet are bonded together, but the last sheet to be included in the preceding booklet and the first sheet to be included in the subsequent booklet are not bonded together. This improves the productivity of the sheet handling apparatus.

(Item 2)

The finisher control unit 650 and the CPU 651 are examples of a control unit. When the sheet bundle W is complete, the sheet bundle is conveyed to the stacker. If the number of sheets included in the sheet bundle is N, the sheet bundle is complete. As described in the first embodiment, in cases where the last sheet in the job is stacked in a sheet bundle, the sheet bundle is completed. As described in the second embodiment, in some cases, the subsequent booklet cannot be stacked at the stacker. In such cases, if the sheet input to the bundling mechanism is a sheet corresponding to the last page of a booklet, the sheet bundle is completed. In other words, in a case where the i-th sheet that has arrived at the bundling mechanism is the M-th sheet in the L-th booklet, the sheet bundle is completed.

(Item 3)

As described in the first embodiment, in such cases, even if the number of sheets included in the sheet bundle is less than N, the sheet bundle is handled as if it is completed.

(Item 4)

As described in the second embodiment, in some cases, a plurality of booklets to be created via one job cannot be stacked at the stacker. In such cases, when L number of booklets are completed, the L number of booklets are discharged from the stacker.

(Item 5)

As described in the second embodiment, in some cases, a plurality of booklets to be created via one job cannot be stacked at the stacker. In other words, in some cases, from the first booklet to the L-th booklet can be stacked at the stacker, but the L+1-th booklet cannot be stacked at the stacker. In such cases, after the first to L-th booklet are discharged, the L+1-th booklet is stacked at the stacker.

(Item 6)

Until the discharge of the preceding sheet bundle is complete, the CPU 651 delays the input of a sheet for forming the subsequent sheet bundle. Accordingly, the preceding sheet bundle and the subsequent sheet bundle do not collide in the bundling mechanism. In other words, the subsequent sheet bundle does not interfere with the discharge of the preceding sheet bundle.

(Item 7)

Item 7 is illustrated in FIG. 12. In this manner, the sheet bundle to be included in the subsequent booklet does not interfere with the discharge of the preceding booklet. In other words, discharge of the preceding booklet can be performed smoothly.

(Item 8)

Case (1): The number i is less than N, the i-th sheet that has arrived at the bundling mechanism is the M-th sheet of the booklet, and the booklet being created at the stacker is the L-th booklet.

Case (2): The number i is less than N, the i-th sheet that has arrived at the bundling mechanism is the M-th sheet of the booklet, and the booklet being created at the stacker is not the L-th booklet.

Case (3): The number i is less than N and the i-th sheet that has arrived at the bundling mechanism is not the M-th sheet of the booklet.

These three cases are as described using FIG. 12. (1) corresponds to the case of No in S1002, Yes in S1005, and No in S1006. (2) corresponds to the case of No in S1002, Yes in S1005, and Yes in S1006. Here, a case in which it is not the L-th booklet is, for example, a case in which the booklet being stacked at the stacker is the L−1-th booklet from the first booklet. (3) corresponds to the case of No in S1002 and No in S1005.

(Item 9)

The image forming apparatus 100 is an example of an image forming unit. By using such an adhesion mechanism, in one sheet bundle, the sheet of a preceding booklet and the sheet of a subsequent booklet can be mixed. As a result, compared to a post-processing apparatus using staples, the productivity of the sheet handling apparatus is improved.

(Item 10)

An electro-photographic image forming apparatus can be connected to the sheet handling apparatus. Typically, an electro-photographic image forming apparatus forms images using four toners, Y, M, C, and K. K can be formed from Y, M, and C, and thus instead of K toner, an adhesive toner may be used. In this case, an image forming apparatus designed to fit four process cartridges can be used as the image forming apparatus 100 according to the first and second embodiment.

(Item 11)

The buffering portion 80 is an example of a layering mechanism. Also, each one of the plurality of sheet bundles basically includes a predetermined number (N) of sheets. In other words, a sheet of the preceding booklet and a sheet of the subsequent booklet may be included in one sheet bundle. Accordingly, compared to a sheet handling apparatus in which a sheet of a preceding booklet and a sheet of a subsequent booklet cannot be included in one sheet bundle, the productivity of the sheet handling apparatus according to the first and second embodiment is high.

(Item 12)

As illustrated in FIG. 8, the sheet (last page) on the top of the sheet bundle that has arrived at the stacker may correspond to the last page of a booklet. In this case, all of the booklets stacked at the stacker are discharged. This corresponds to a case in which the sheet (last page) on the top of the sheet bundle that has arrived at the stacker corresponds to the last page of a job. FIGS. 11 and 12 also illustrate an example in which the sheet (last page) on the top of the sheet bundle that has arrived at the stacker corresponds to the last page of a booklet.

(Item 13)

Item 13 is illustrated in FIG. 12. This helps suppress overflow at the stacker.

(Item 14)

As illustrated in FIGS. 5A and 5B, thermocompression bonding may be performed for each sheet bundle. Accordingly, a plurality of sheets can be reliably bonded together with a small amount of heat.

(Item 15)

An adhesive with a low adhesiveness at normal temperatures and a high adhesiveness at high temperatures may be used. This is suitable for the electro-photographic image forming apparatus 100 using thermal fixing.

(Item 16)

A sheet of the preceding booklet and a sheet of the subsequent booklet can be conveyed via the same sheet bundle.

(Item 17)

An image forming system is provided.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2023-080366, filed May 15, 2023 which is hereby incorporated by reference herein in its entirety.

What is claimed is:

1. A sheet handling apparatus comprising:

a bundling mechanism that forms a sheet bundle including a maximum of N sheets, with sheets being received one at a time;

a conveyer that conveys the sheet bundle in a case where formation of the sheet bundle is complete;

a stacker that stacks the sheet bundle conveyed by the conveyer;

an adhesion mechanism that creates a booklet including M sheets by performing a bonding process each time the sheet bundle is stacked at the stacker; and a discharger that, in a case where formation of L booklets is complete at the stacker, discharges the L booklets from the stacker, wherein the bundling mechanism is configured to create a sheet bundle including N sheets including an M-th sheet to be included in a k-th booklet and a first sheet to be included in a k+1-th booklet, where k is an integer from 1 to L−1 and M is not a multiple of N, and the adhesion mechanism is configured to bond together a preceding sheet and a subsequent sheet stacked at the stacker, except for the M-th sheet to be included in the k-th booklet and the first sheet to be included in the k+1-th booklet.

2. The sheet handling apparatus according to claim 1, further comprising:

a controller that controls the bundling mechanism, the conveyer, the stacker, the adhesion mechanism, and the discharger, wherein the controller is further configured to:

count a number i of sheets layered at the bundling mechanism;

in a case where the i equals the N, cause the conveyer to convey the sheet bundle from the bundling mechanism to the stacker; and in a case where the i is less than the N and an i-th sheet that has arrived at the bundling mechanism is an M-th sheet in an L-th booklet, cause the conveyer to convey the sheet bundle from the bundling mechanism to the stacker.

3. The sheet handling apparatus according to claim 2, wherein the L-th booklet is a last booklet in a single job, and the M-th sheet in the L-th booklet is a sheet corresponding to a last page in the single job.

4. The sheet handling apparatus according to claim 2, wherein the L-th booklet is created with a single job for forming Y booklets, where Y is an integer greater than L.

5. The sheet handling apparatus according to claim 4, wherein the controller is further configured to:

in a case where a total number of sheets included from a first booklet to the L-th booklet is not greater than a maximum number that can be stacked at the stacker and a total number of sheets included from the first booklet to an L+1-th booklet is greater than the maximum number, and a last sheet included in the L-th booklet arrives at the bundling mechanism, cause the conveyer to convey the sheet bundle from the bundling mechanism to the stacker; and cause the discharger to discharge from the first booklet to the L-th booklet.

6. The sheet handling apparatus according to claim 4, wherein the controller is further configured to delay receiving a first sheet of an L+1-th booklet at the bundling mechanism until discharge of a sheet bundle including the M-th sheet in the L-th booklet is completed by the bundling mechanism.

7. The sheet handling apparatus according to claim 6, wherein the controller is further configured to delay conveying a sheet bundle for forming the L+1-th booklet from the bundling mechanism to the stacker until discharge of from a first booklet to the L-th booklet is completed by the discharger.

8. The sheet handling apparatus according to claim 2, wherein the controller is further configured to:

in a case where the number i equals the number N, cause the conveyer to convey the sheet bundle from the bundling mechanism to the stacker;

(1) in a case where the number i is less than the number N, an i-th sheet that has arrived at the bundling mechanism is an M-th sheet in the booklet, and a booklet being created at the stacker is an L-th booklet, cause the conveyer to convey a sheet bundle from the bundling mechanism to the stacker;

(2) in a case where the number i is less than the number N, an i-th sheet that has arrived at the bundling mechanism is an M-th sheet in the booklet, and a booklet being created at the stacker is not the L-th booklet, cause an i+1-th sheet to be received at the bundling mechanism; and (3) in a case where the number i is less than the number N, an i-th sheet that has arrived at the bundling mechanism is not an M-th sheet in the booklet, cause the i+1-th sheet to be received at the bundling mechanism.

9. The sheet handling apparatus according to claim 1, further comprising:

an image forming unit that forms an image on the sheet and forms an adhesive pattern with a hot-melt adhesive on remaining sheets in the booklet that are not a cover, wherein the adhesion mechanism is further configured to apply heat to a sheet bundle stacked at the stacker to melt an adhesive pattern formed on a subsequent sheet and bond a preceding sheet to the subsequent sheet.

10. The sheet handling apparatus according to claim 9, wherein the adhesive pattern is formed with toner.

11. A sheet handling apparatus comprising:

a layering mechanism that forms a sheet bundle by layering a plurality of sheets and temporarily holds the sheet bundle;

a conveyer that conveys the sheet bundle held at the layering mechanism;

a stacker that stacks one or more sheet bundles conveyed to the stacker by the conveyer;

an adhesion mechanism that forms a booklet by performing a bonding process on one or more sheet bundles stacked at the stacker;

a discharger that discharges the booklet from the stacker; and a controller that controls the number of sheets included in each sheet bundle formed by the layering mechanism and discharge of the booklet by the discharger, wherein the controller is further configured to:

in a case where the number of sheets layered at the layering mechanism is less than a predetermined number, continue a process of layering sheets by the layering mechanism;

in a case where the number of sheets layered at the layering mechanism is equal to the predetermined number or when the number of sheets layered at the layering mechanism is less than the predetermined number but a sheet located at a top in the layering mechanism is a sheet corresponding to a last page of a job, cause the conveyer to convey a sheet bundle from the layering mechanism to the stacker; and in a case where a sheet located at a top in the sheet bundle conveyed to the stacker from the layering mechanism by the conveyer is a sheet corresponding to the last page in the job, cause the discharger to discharge all booklets stacked in the stacker.

12. The sheet handling apparatus according to claim 11, wherein in a case where a sheet located at a top in the sheet bundle conveyed to the stacker from the layering mechanism by the conveyer is a sheet corresponding to a last page of a booklet, the controller causes the discharger to discharge all booklets stacked in the stacker.

13. The sheet handling apparatus according to claim 12, wherein in a case where a sum of the number of sheets forming a preceding booklet stacked at the stacker and the number of sheets forming a subsequent booklet is greater than a predetermined number, the controller does not allow a sheet corresponding to a last page of the preceding booklet and a sheet corresponding to a first page of the subsequent booklet to be mixed at the layering mechanism.

14. The sheet handling apparatus according to claim 11, wherein the controller is further configured to cause the adhesion mechanism to perform the bonding process each time a sheet bundle is stacked at the stacker.

15. The sheet handling apparatus according to claim 11, further comprising:

an image forming unit that forms an image on the sheet and forms an adhesive pattern with a hot-melt adhesive on remaining sheets in the booklet that are not a cover, wherein the adhesion mechanism applies heat to a sheet bundle stacked at the stacker to melt an adhesive pattern formed on a subsequent sheet and bond a preceding sheet to the subsequent sheet.

16. The sheet handling apparatus according to claim 11, wherein the layering mechanism layers a sheet corresponding to a first page in a subsequent booklet on a sheet corresponding to a last page in a preceding booklet to mix one or more sheets forming the preceding booklet and one or more sheets forming the subsequent booklet in the sheet bundle.

17. An image forming system comprising:

an image forming apparatus that forms an image on a sheet; and a sheet handling apparatus connected to the image forming apparatus, wherein the sheet handling apparatus includes a bundling mechanism that forms a sheet bundle including a maximum of N sheets, with sheets being received one at a time from the image forming apparatus, a conveyer that conveys the sheet bundle when formation of the sheet bundle is complete, a stacker that stacks the sheet bundle conveyed by the conveyer, an adhesion mechanism that creates a booklet includes M sheets by performing a bonding process each time the sheet bundle is stacked at the stacker, a discharger that, when formation of L booklets is complete at the stacker, discharges the L booklets from the stacker, and a controller that controls the bundling mechanism, the conveyer, the stacker, the adhesion mechanism, and the discharger, and the controller is further configured to:

count a number i of sheets layered at the bundling mechanism;

in a case where the i equals the N, cause the conveyer to convey the sheet bundle from the bundling mechanism to the stacker; and in a case where the i is less than the N and an i-th sheet that has arrived at the bundling mechanism is an M-th sheet in an L-th booklet, cause the conveyer to convey the sheet bundle from the bundling mechanism to the stacker.

* * * * *